US007244020B2

(12) United States Patent
Chikamoto

(10) Patent No.: US 7,244,020 B2
(45) Date of Patent: Jul. 17, 2007

(54) INKJET HEAD, FILTER PLATE FOR INKJET HEAD, AND METHOD OF MANUFACTURING FILTER PLATE

(75) Inventor: Tadanobu Chikamoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 220 days.

(21) Appl. No.: 11/000,454

(22) Filed: Dec. 1, 2004

(65) Prior Publication Data

US 2005/0116989 A1 Jun. 2, 2005

(30) Foreign Application Priority Data

Dec. 1, 2003 (JP) ..... 2003-401698

(51) Int. Cl.
*B41J 2/175* (2006.01)

(52) U.S. Cl. ..... 347/93

(58) Field of Classification Search ..... None
See application file for complete search history.

(56) References Cited

U.S. PATENT DOCUMENTS 5,204,690 A 4/1993 Lorenze, Jr. et al.
5,489,930 A 2/1996 Anderson
5,610,645 A * 3/1997 Moore et al. ..... 347/93
5,850,241 A 12/1998 Silverbrook
6,086,195 A 7/2000 Bohorquez et al.
6,685,299 B2 2/2004 Hirota
7,047,642 B2 5/2006 Kataoka et al.

FOREIGN PATENT DOCUMENTS

EP 1 236 573 A2 9/2002
EP 1 336 486 A2 8/2003
JP 6-255101 A 9/1994
JP 2000-296613 A 10/2000
JP 2002-355962 A 12/2002

* cited by examiner

*Primary Examiner*—Thinh Nguyen
(74) *Attorney, Agent, or Firm*—Oliff & Berridge, PLC

(57) ABSTRACT

An ink channel is formed in an inkjet head, so that ink introduced through an ink inlet passes through a pressure chamber and is ejected out of a nozzle. A filter for filtering the ink is disposed in the ink channel. The filter includes a depression formed in a plate, and a plurality of through-holes formed in the bottom of the depression. The filter has small channel resistance and is easy to handle.

23 Claims, 12 Drawing Sheets

FIG. 12 ( a )
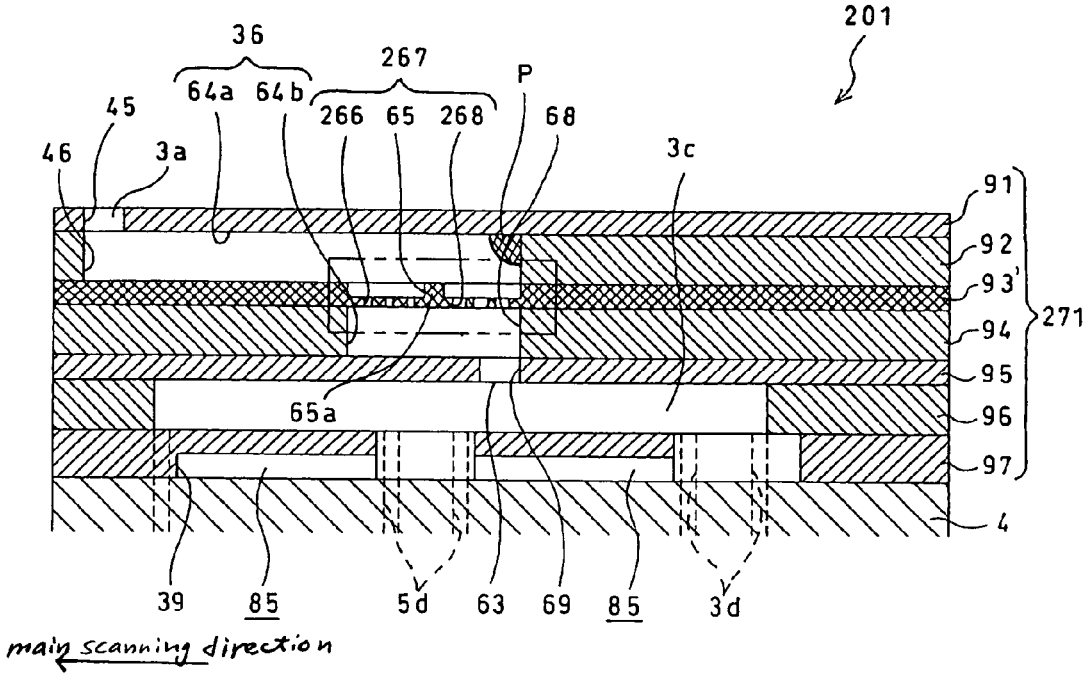
FIG. 12 ( b )
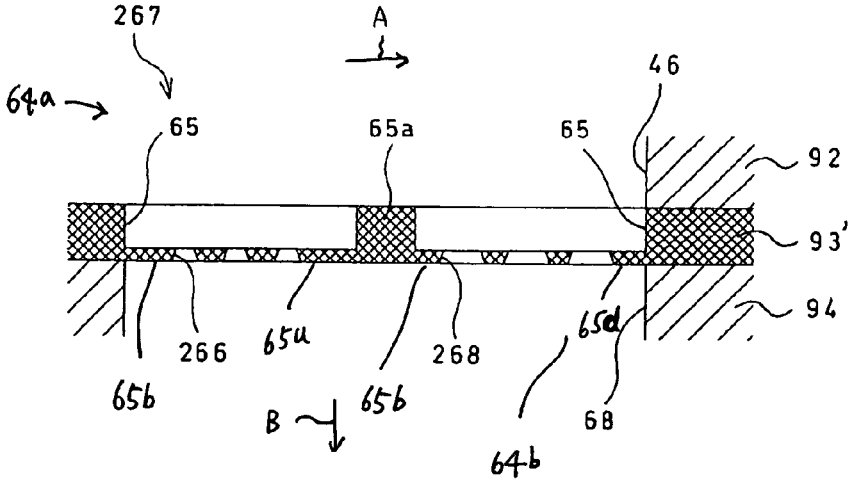

INKJET HEAD, FILTER PLATE FOR INKJET HEAD, AND METHOD OF MANUFACTURING FILTER PLATE

BACKGROUND OF THE INVENTION

1. Field of the Invention

The present invention relates to an inkjet head for performing a printing operation by ejecting ink onto a recording medium; a filter plate for an inkjet head having a filter for trapping foreign matter in the ink; and a method for manufacturing the filter plate.

2. Description of Related Art

Japanese unexamined patent application publication No. HEI-6-255101 discloses an inkjet head configured of laminated channel plates and having nozzles for ejecting ink, ink pressure chambers for applying pressure to the ink, a common ink chamber for distributing ink to each of the ink pressure chambers, and a supply channel for supplying ink from an ink tank to the common ink chamber. In this ink-jet head, a filter having a plurality of through-holes formed by etching or the like is disposed between the common ink chamber and the supply channel. Accordingly, foreign matter in ink supplied from the ink tank can be trapped by the filter so that the matter does not enter the common ink chamber. Therefore, the inkjet head can prevent problems in ink ejection caused by foreign matter clogging the ink channel.

SUMMARY OF THE INVENTION

However, in the inkjet head disclosed in the document described above, the channel plate in which the filter is formed is extremely thin and weak and, therefore, must be handled delicately when stacked with the other channel plates, making the laminating process difficult.

To resolve this problem, it is conceivable to use a thicker channel plate. However, when forming filter through-holes in the channel plate by etching, for example, the diameter of the through-holes grows larger in proportion to the thickness of the plate, giving rise to a new problem of a filter having an insufficient capacity to trap foreign matter, which capacity determines the filtering characteristics.

When forming through-holes by etching, generally a resist layer having openings approximately the same diameter as the filter through-holes is coated on one surface of the channel plate, and the regions exposed in the openings are etched by a chemical solution. However, since the etching proceeds isotropically and not only in the thickness direction of the plate, by the time through-holes are formed penetrating a thick plate, the etching has proceeded also to the underside of the resist layer, resulting in through-holes with a large diameter.

Therefore, it is an object of the present invention to provide an inkjet head that improves the strength of the plate in which a filter portion is formed without a loss in filtering characteristics, making the plate easy to handle.

It is another object of the present invention to provide a filter plate that is strong and easy to handle, without a loss in filtering characteristics, and a method for manufacturing such a filter plate.

In order to attain the above and other objects, the present invention provides an inkjet head including a plurality of laminated plates. The plates have holes that are arranged in communication with one another to form an ink channel. At least one of the plurality of plates includes a filter portion disposed in the ink channel. The filter portion includes a bottom wall portion defining a depression thereon. A plurality of filter through-holes are formed through the bottom wall portion.

According to another aspect, the present invention provides a filter plate for an inkjet head. The inkjet head includes a plurality of laminated plates. The plurality of plates include the filter plate. The plurality of laminated plates have holes that are arranged to form an ink channel. The filter plate includes a filter portion. The filter portion is disposed in the ink channel which is formed when the plurality of plates are laminated together. The filter portion includes a bottom wall portion defining a depression thereon. A plurality of filter through-holes are formed through the bottom wall portion.

According to another aspect, the present invention provides a method of manufacturing a filter plate serving as a component of an inkjet head including a plurality of laminated plates. The plates have holes that are arranged to form an ink channel. The filter plate has a filter portion that traps foreign matter in ink in the ink channel. The method includes: forming a plurality of holes within a predetermined region on one surface of a metal plate, the holes having a depth smaller than the thickness of the metal plate; and forming filter through-holes penetrating the metal plate by etching a depression across the entire predetermined region on the opposite surface of the metal plate, the depression connecting the holes, thereby forming through-holes.

According to another aspect, the present invention provides a filter plate for an inkjet head. The inkjet head includes a plurality of laminated plates including the filter plate. The plurality of laminated plates have holes that are arranged to form an ink channel. The filter plate is formed with a depression that is to be located in the ink channel when the plurality of plates are laminated together. A plurality of filter through-holes are formed through a bottom portion of the depression.

According to another aspect, the present invention provides an inkjet head including a plurality of laminated plates. The plates have holes that are arranged in communication with one another to form an ink channel. At least one of the plurality of plates is formed with a depression at a location in the ink channel. A plurality of filter through-holes are formed through a bottom of the depression.

BRIEF DESCRIPTION OF THE DRAWINGS

The above and other objects, features and advantages of the invention will become more apparent from reading the following description of the preferred embodiments taken in connection with the accompanying drawings in which:

FIG. 6(*b*) is a plan view of an aperture shown in FIG. 6(*a*);

FIG. 8(*b*) is a plan view of an individual electrode shown in FIG. 8(*a*);

FIG. 9(*b*) is an enlarged cross-sectional view of a region in FIG. 9(*a*) surrounded by a broken line with alternating long and double short dashes;

FIGS. 12(*a*) and 12(*b*) are cross-sectional views of the reservoir unit in an inkjet head according to a second embodiment of the present invention, wherein FIG. 12(*a*) is a cross-sectional view of the entire reservoir unit, and FIG. 12(*b*) is an enlarged cross-sectional view of a region in FIG. 12(*a*) surrounded by a broken line with alternating long and double short dashes.

DETAILED DESCRIPTION OF THE PREFERRED EMBODIMENTS

Figure 1:
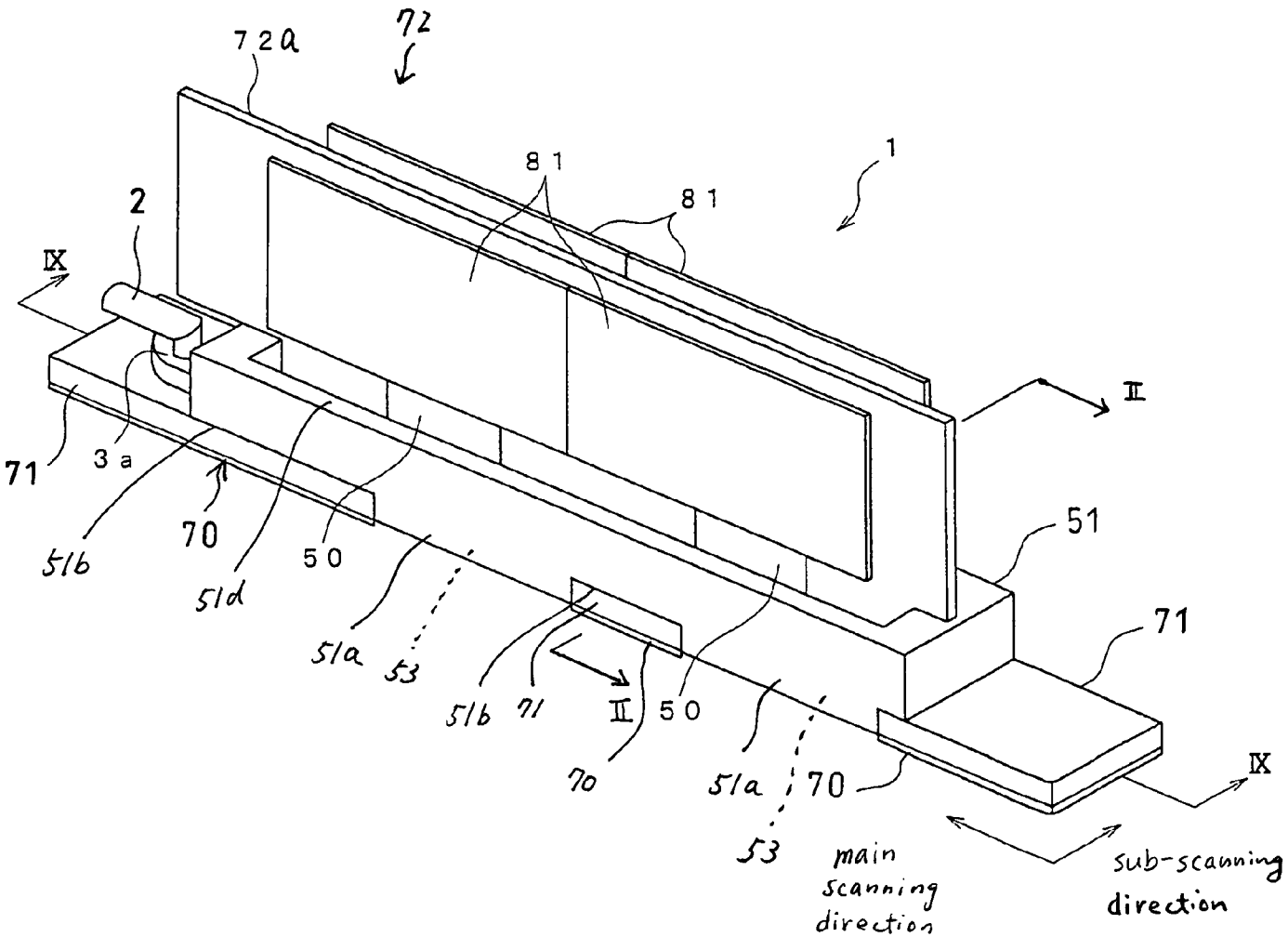
FIG. 1 is an external perspective view of an ink-jet head according to a first embodiment of the present invention.

An inkjet head according to preferred embodiments of the present invention will be described while referring to the accompanying drawings wherein like parts and components are designated by the same reference numerals to avoid duplicating description.

Figure 2:
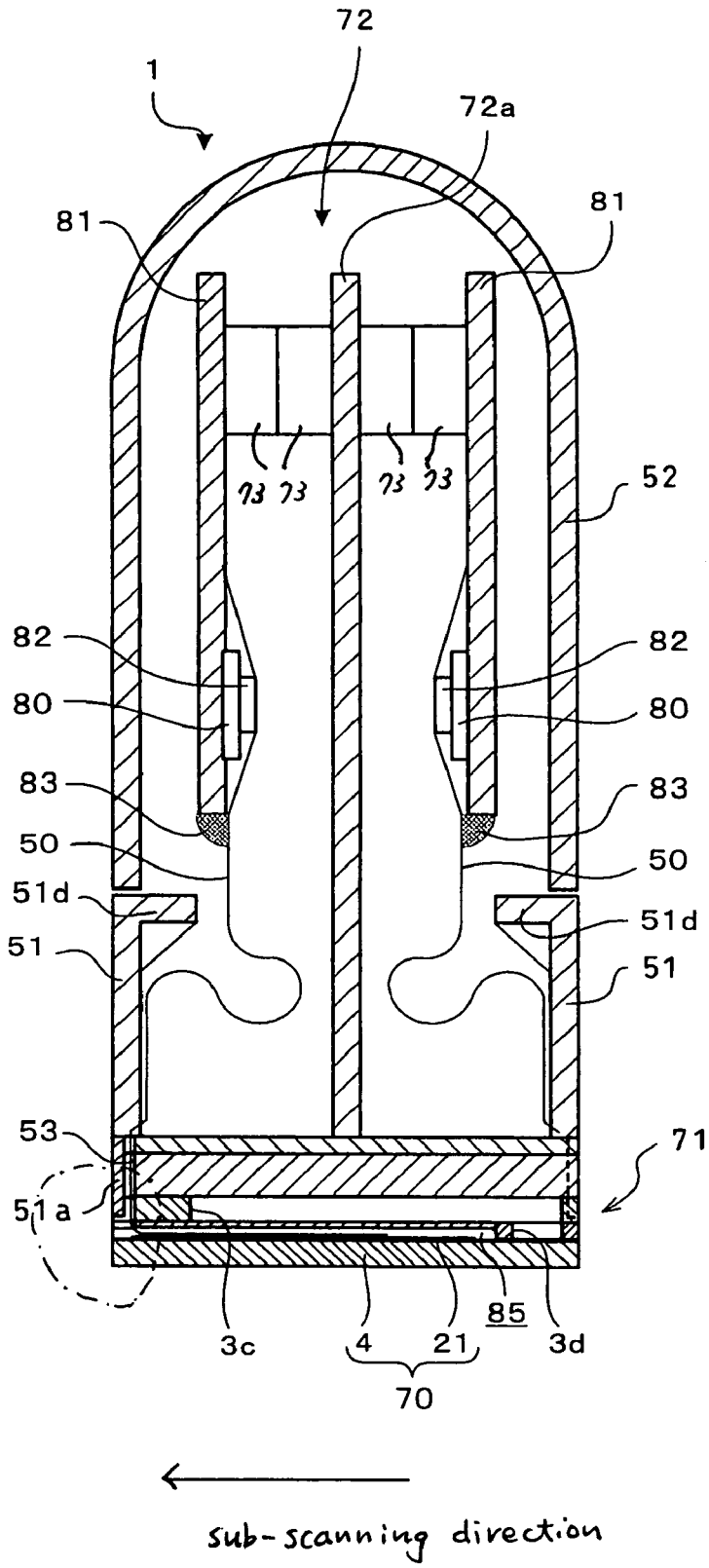
FIG. 2 is a cross-sectional view taken along a line II—II in FIG. 1.
Figure 3:
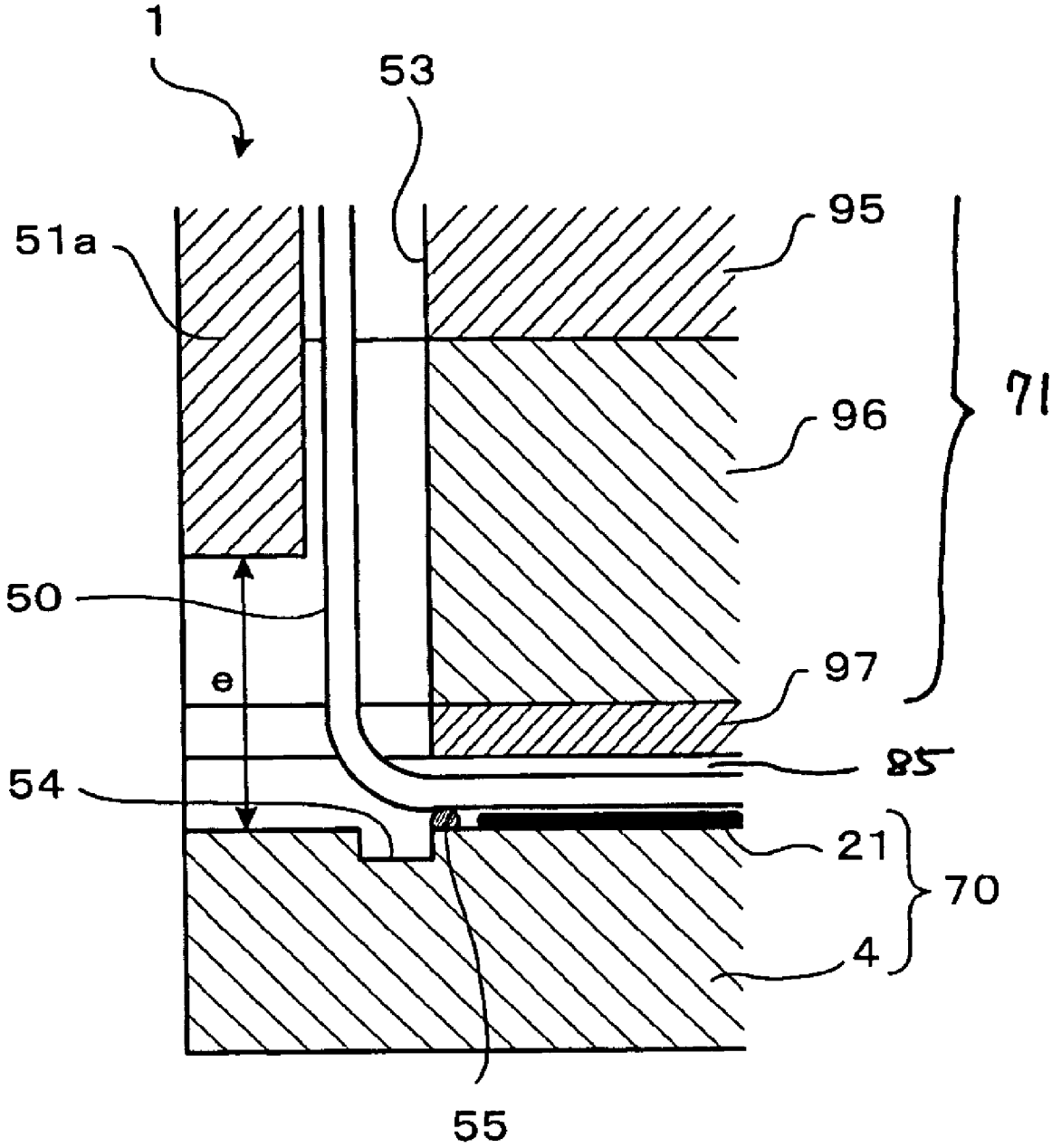
FIG. 3 is an enlarged view of a region in FIG. 2 surrounded by a one-dot-and-one-chain line.

FIG. 1 is an external perspective view of an ink-jet head 1 according to a first embodiment of the present invention. FIG. 2 is a cross-sectional view taken along a line II—II in FIG. 1. FIG. 3 is an enlarged view of a region in FIG. 2 surrounded by a one-dot-and-one-chain line.

Figure 9:
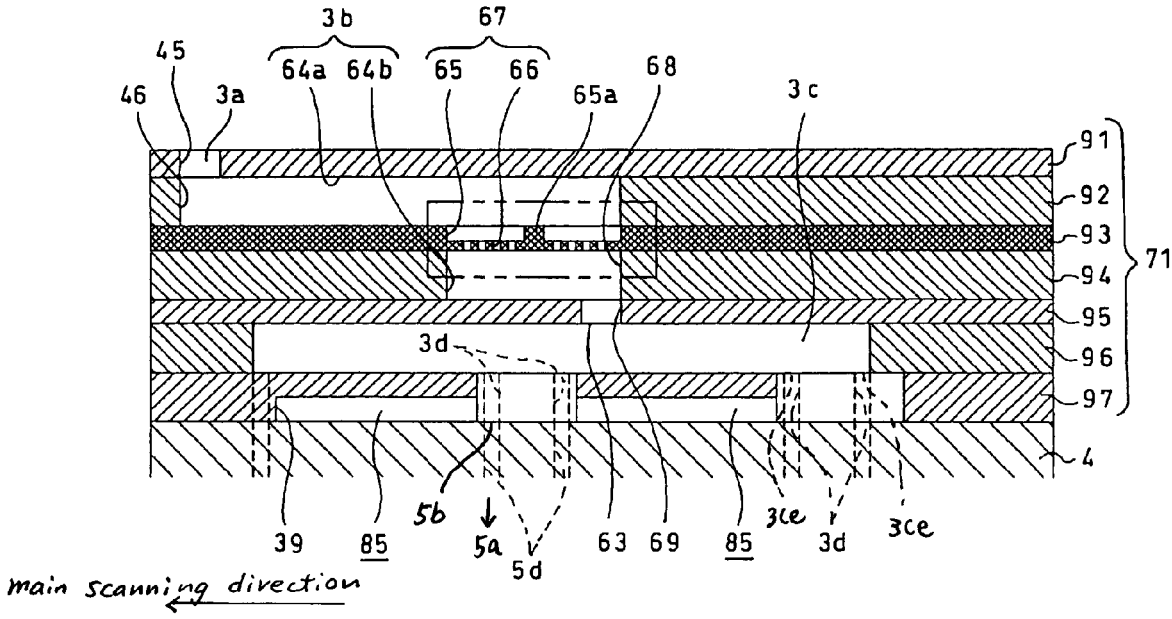
FIG. 9(*a*) is a cross-sectional view of a reservoir unit taken along a line IX—IX in FIG. 1.
Figure 9:
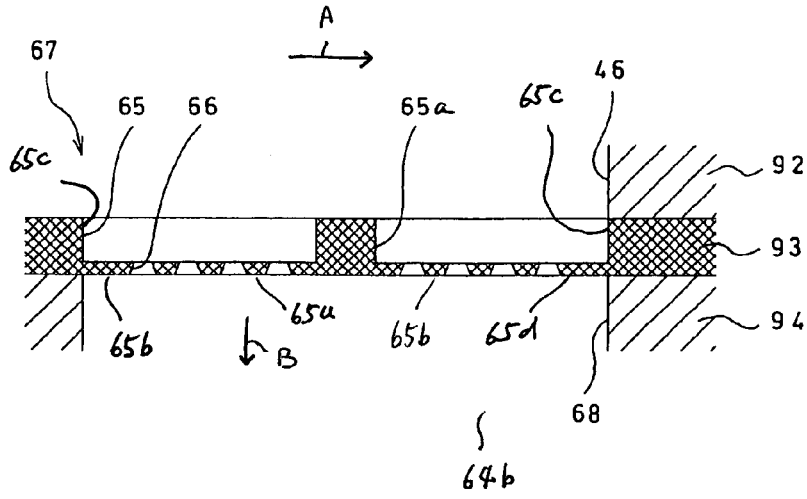

The inkjet head 1 includes: a main head member 70 having a flat rectangular shape extending in a main scanning direction and functioning to eject ink onto paper; a reservoir unit 71 disposed on the top surface of the main head member 70 and having an ink reservoir 3*c* (FIG. 9(*a*)) for accommodating ink to be supplied to the main head member 70; a controller 72 disposed above the reservoir unit 71 for controlling the main head member 70; and a lower cover 51 and an upper cover 52 for protecting the inkjet head 1 from sprayed ink. For the convenience of description, the upper cover 52 is omitted from FIG. 1, but is shown in FIG. 2. A sub-scanning direction is defined perpendicularly to the main scanning direction.

Figure 4:
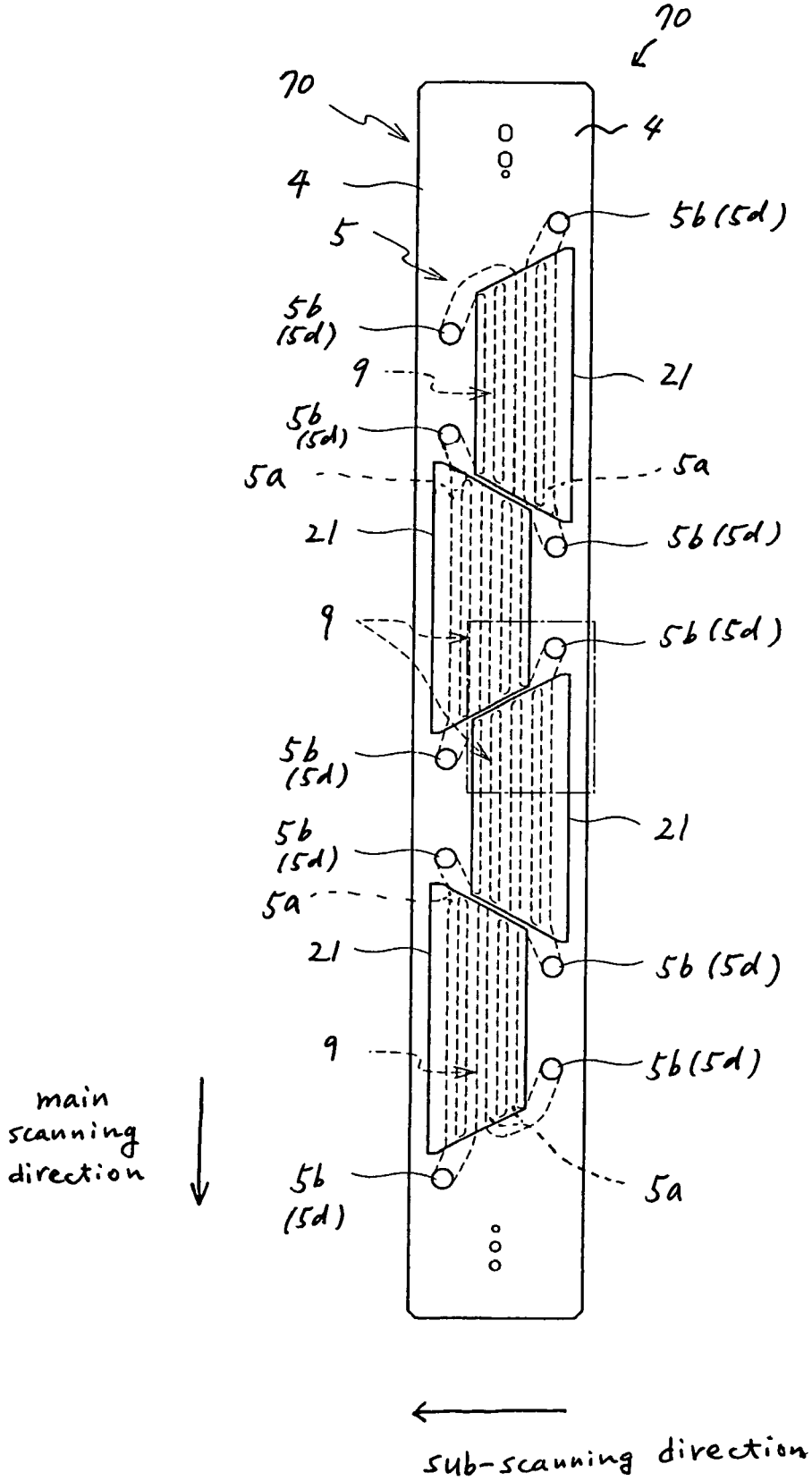
FIG. 4 is a plan view of a main head member shown in FIG. 1.

As shown in FIGS. 2 and 3, the main head member 70 includes: a channel unit 4 in which ink channels are formed; and a plurality of (four, in this embodiment) actuator units 21 bonded to the top surface of the channel unit 4 (FIG. 4). Each actuator unit 21 has a laminated structure in which a plurality of thin plates are stacked and bonded together as will be described with reference to FIG. 8.

Figure 10:
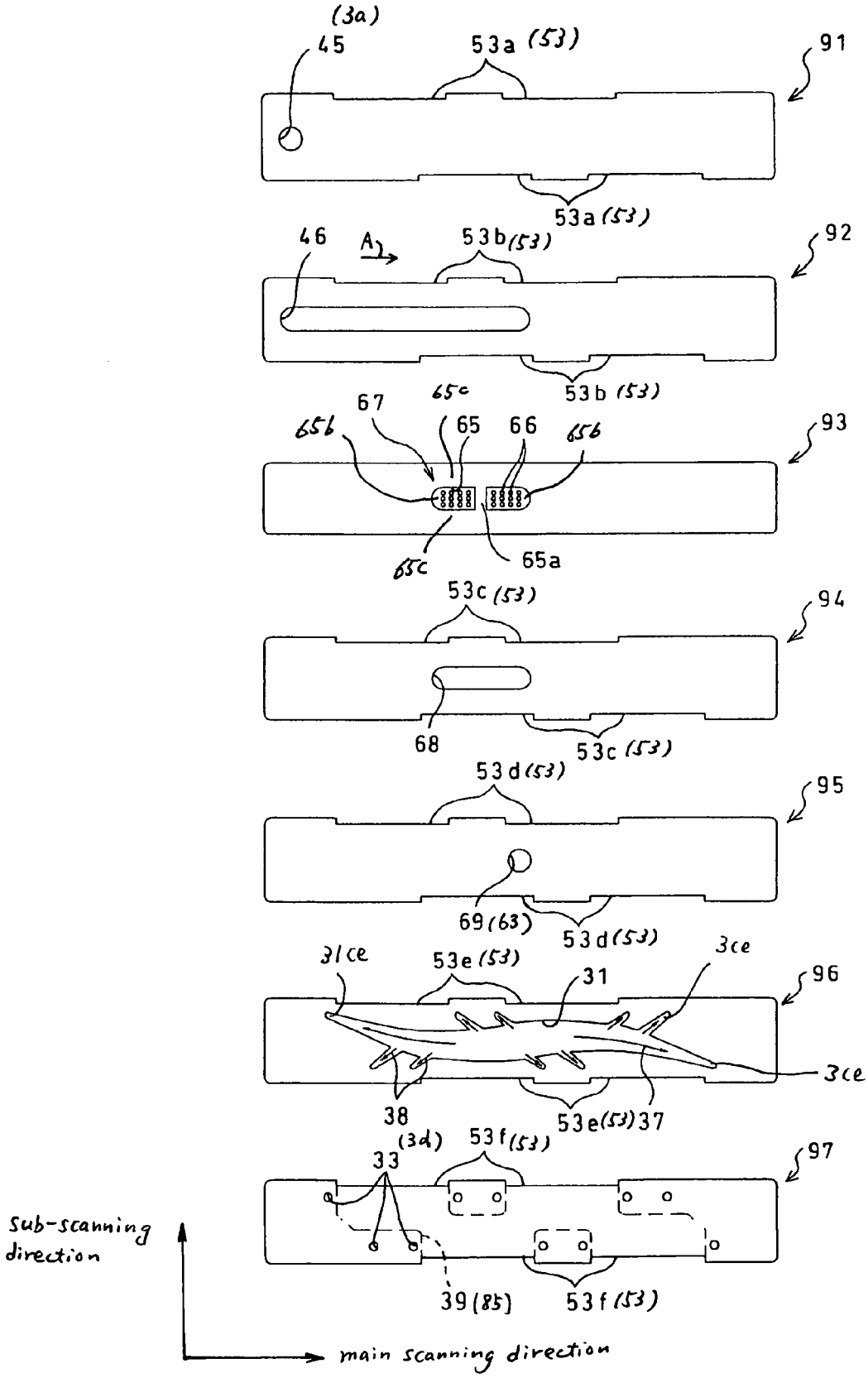
FIG. 10 is an exploded view of the reservoir unit shown in FIG. 1.
Figure 11A:
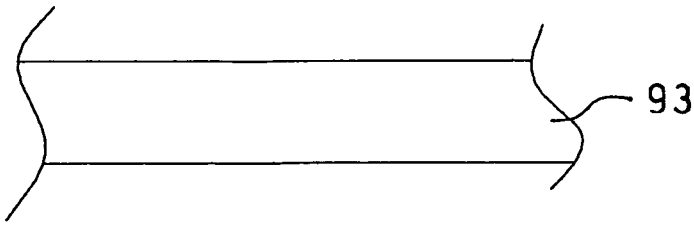
FIGS. 11(*a*)–11(*e*) illustrate a process for manufacturing a filter in a third plate of the reservoir unit shown in FIG. 1, wherein FIG. 11(*a*) shows the third plate as the original plate material prior to forming the filter, FIG. 11(*b*) shows the third plate after resist layers have been formed over the surfaces thereof, FIG. 11(*c*) shows the third plate after holes are formed in the bottom surface and the resist layers are removed from the third plate subsequently, FIG. 11(*d*) shows the third plate after resist layers are again formed on the surfaces thereof, and FIG. 11(*e*) shows the completed filter formed in the third plate after a depression is formed and the resist layers are removed from the third plate subsequently.
Figure 11B:
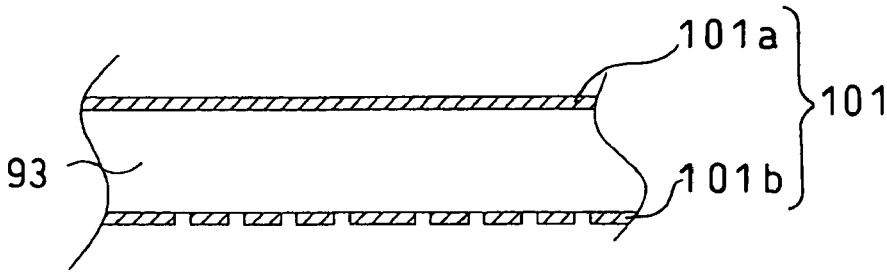
Figure 11C:
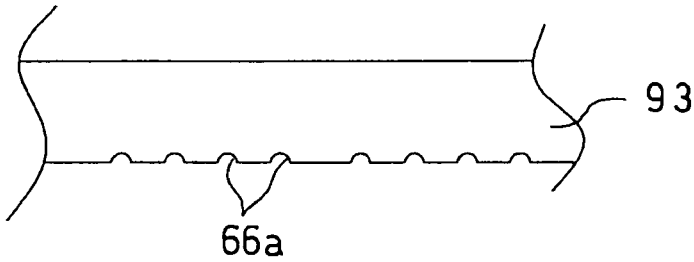
Figure 11D:
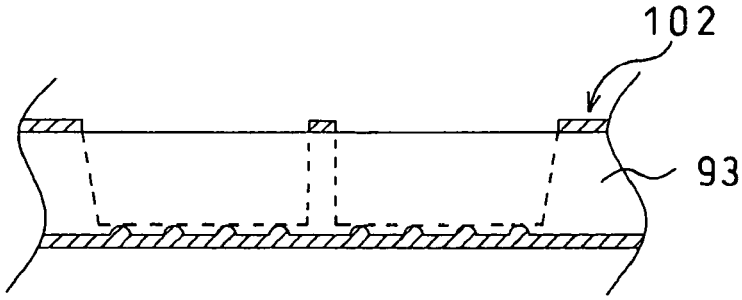
Figure 11E:
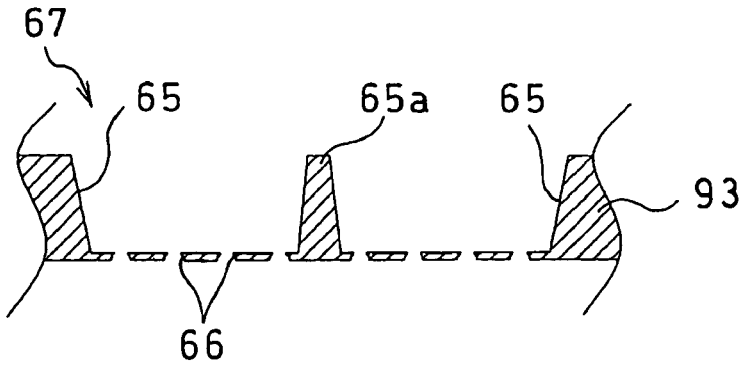

As shown in FIG. 2, FIG. 9(*a*), and FIG. 10, the reservoir unit 71 is formed with a plurality of (ten, in this embodiment) upper ink supply channels 3*d*. The upper ink supply channels 3*d* extend downward and are opened on the bottom surface of the reservoir unit 71. As shown in FIG. 10, the upper ink supply channels 3*d* are located near both ends of the reservoir unit 71 with respect to the sub-scanning direction. The reservoir unit 71 contacts the channel unit 4 only at portions surrounding the openings of the upper ink supply channels 3*d* on the bottom surface of the reservoir unit 71. Accordingly, remaining regions of the reservoir unit 71 other than the portions surrounding the upper ink supply channels 3*d* are located separate from the main head member 70, forming a space 85. The actuator units 21 are disposed in the space 85.

A plurality of (four, in this embodiment) flexible printed circuits (FPCs) 50 are provided for supplying electricity to the plurality of (four, in this embodiment) actuator units 21, respectively. The FPCs 50 are electrically connected to the top surfaces of the actuator units 21, respectively. Two FPCs 50 are led away from one side of the channel unit 4 in the sub-scanning direction, while the other two FPCs 50 are led away from the other side of the channel unit 4 in the sub-scanning direction.

As shown in FIG. 1 and FIG. 9(*a*), the reservoir unit 71 includes: an ink inlet 3*a* and an ink downflow channel (reservoir channel) 3*b*. An ink supply connector 2 is attached to the ink inlet 3*a*. An ink tube (not shown) is connected to the ink supply connector 2. The ink downflow channel 3*b* has a downflow opening 63. Ink supplied from an ink tank (not shown) into the ink inlet 3*a* via the ink tube (not shown) and the ink supply connector 2 flows through the ink down-flow channel 3*b*, through the downflow opening 63, and accumulates in the ink reservoir 3*c*.

Ink accumulated in the ink reservoir 3*c* is supplied from the plurality of the upper ink supply channels 3*d* to a plurality of (ten, in this embodiment) lower ink supply channels 5*d*, which are formed in the channel unit 4 in one-to-one correspondence with the upper ink supply channels 3*d* as shown in FIG. 4. A manifold (common ink chamber) 5 is also formed in the channel unit 4 as shown in FIG. 4. The lower ink supply channels 5*d* are in fluid communication with the manifold 5.

As shown in FIG. 1, FIG. 3, and FIG. 10, a plurality of (four, in this embodiment) rectangular cutouts or recesses 53 are formed on the reservoir unit 71 in the thickness direction of the reservoir unit 71. The rectangular cutouts 53 are formed two on each side of the reservoir unit 71 with respect to the sub-scanning direction so that the rectangular cutouts 53 on opposing sides are staggered with respect to each other.

As shown in FIGS. 2, 3, and 10, the space 85 is in fluid communication with the rectangular cutouts 53. Each FPC 50 extends from the corresponding actuator unit 21, passes through the space 85, and passes through the corresponding rectangular cutout 53. As shown in FIGS. 1, 4, and 10, except for the rectangular cutouts 53, the reservoir unit 71 has essentially the same shape and dimensions in plan as the channel unit 4.

The controller 72 functions to control driving of the inkjet head 1. As shown in FIG. 1 and FIG. 2, the controller 72 includes: a main circuit board 72*a*; a plurality of (four, in this embodiment) sub-circuit boards 81; and a plurality of (four, in this embodiment) driver ICs 80.

The main circuit board 72*a* has a rectangular shape extending in the main scanning direction and is fixed on the reservoir unit 71 such that the surfaces opposing the sub-circuit boards 81 are perpendicular to the top surface of the reservoir unit 71. The sub-circuit boards 81 are disposed in parallel to the surfaces of the main circuit board 72*a* and are electrically connected to the main circuit board 72*a* via connectors 73.

Each driver IC 80 functions to generate signals for driving a corresponding actuator unit 21. Each driver IC 80 is provided with a heat sink 82. Each driver IC 80 is fixedly mounted on a corresponding sub-circuit board 81 on its side that confronts the main circuit board 72*a*.

Each FPC 50 is electrically connected to both of a corresponding sub-circuit board 81 and a corresponding driver IC 80. Each FPC 50 is fixed to the sub-circuit boards 81 via adhesive 83. Each FPC 50 is for transferring signals outputted from the sub-circuit board 81 to the driver IC 80, and for transferring drive signals outputted from the driver IC 80 to the corresponding actuator unit 21.

As shown in FIG. 3, each FPC 50 is bent and fixed by an adhesive 55 to the channel unit 4 at a location near an escape groove 54, so that the FPC 50 does not come off of the corresponding actuator unit 21 when pulled upward.

As shown in FIGS. 1 and 2, the lower cover 51 is a substantially rectangular-shaped hollow case and has openings in the bottom and top thereof. The lower case 51 has essentially the same dimension in the sub-scanning direction in plan with the main head member 70 (reservoir unit 71 and channel unit 4). In other words, the cross-section of the lower case 51 along a plane parallel to the top and bottom surfaces of the main head member 70 has the same dimension in the sub-scanning direction with the main head member 70. As shown in FIG. 1, the lower cover 51 has a bottom edge 51*b*. A plurality of (four, in this embodiment) protruding parts 51*a* protrude downwardly from the bottom edge 51*b*. The lower cover 51 is disposed on top of the main head body 70. The bottom edge 51*b* is located on the top surface of the reservoir unit 71, while each protruding part 51*a* is accommodated in a corresponding rectangular cutout 53 of the reservoir unit 71. As shown in FIG. 2, each FPC 50 runs through a gap defined in the corresponding rectangular cutout 53, and is drawn from the top of the reservoir unit 71. The lower cover 51 covers the outer sides of portions of the FPCs 50 that extend along the rectangular cutouts 53 of the reservoir unit 71.

As shown in FIG. 1, FIG. 2, and FIG. 3, each FPC 50 is accommodated in the lower cover 51 to extend loosely over the corresponding actuator unit 21 so as not to be applied with any stress. The bottom edge 51*b* of the lower cover 51 is positioned on the upper edge of the reservoir unit 71, while the protruding parts 51*a* are positioned above the upper edge of the channel unit 4.

As shown in FIG. 3, gaps e are formed between the protruding parts 51*a* and the edge on the upper surface of the channel unit 4 for absorbing error in manufacturing the lower cover 51. After the lower cover 51 has been mounted, the gaps e are filled with a silicone resin or the like to prevent ink from flowing out through the gaps e. The escape grooves 54 are formed in the channel unit 4 at positions opposing the rectangular cutouts 53 for allowing excess silicone to escape when filling the gaps e with silicone resin. As shown in FIGS. 1 and 2, the lower cover 51 further has a horizontal part 51*d*, which surrounds the upper opening. The horizontal part 51*d* is formed by bending the upper edges of the side wall of the lower cover 51 inward along the horizontal. The FPCs 50 are led through the top opening of the lower cover 51 that is surrounded by the planar part 51*d*.

As shown in FIG. 2, the upper cover 52 is a casing with an arch-shaped ceiling, and is disposed on top of the horizontal parts 51*d* of the lower cover 51 for covering the main circuit board 72*a* and the sub-circuit boards 81. When properly positioned, the lower cover 51 and upper cover 52 have a width in the sub-scanning direction that falls within the width of the main head member 70 in the sub-scanning direction.

Next, the structure of the main head member 70 will be described.

Figure 5:
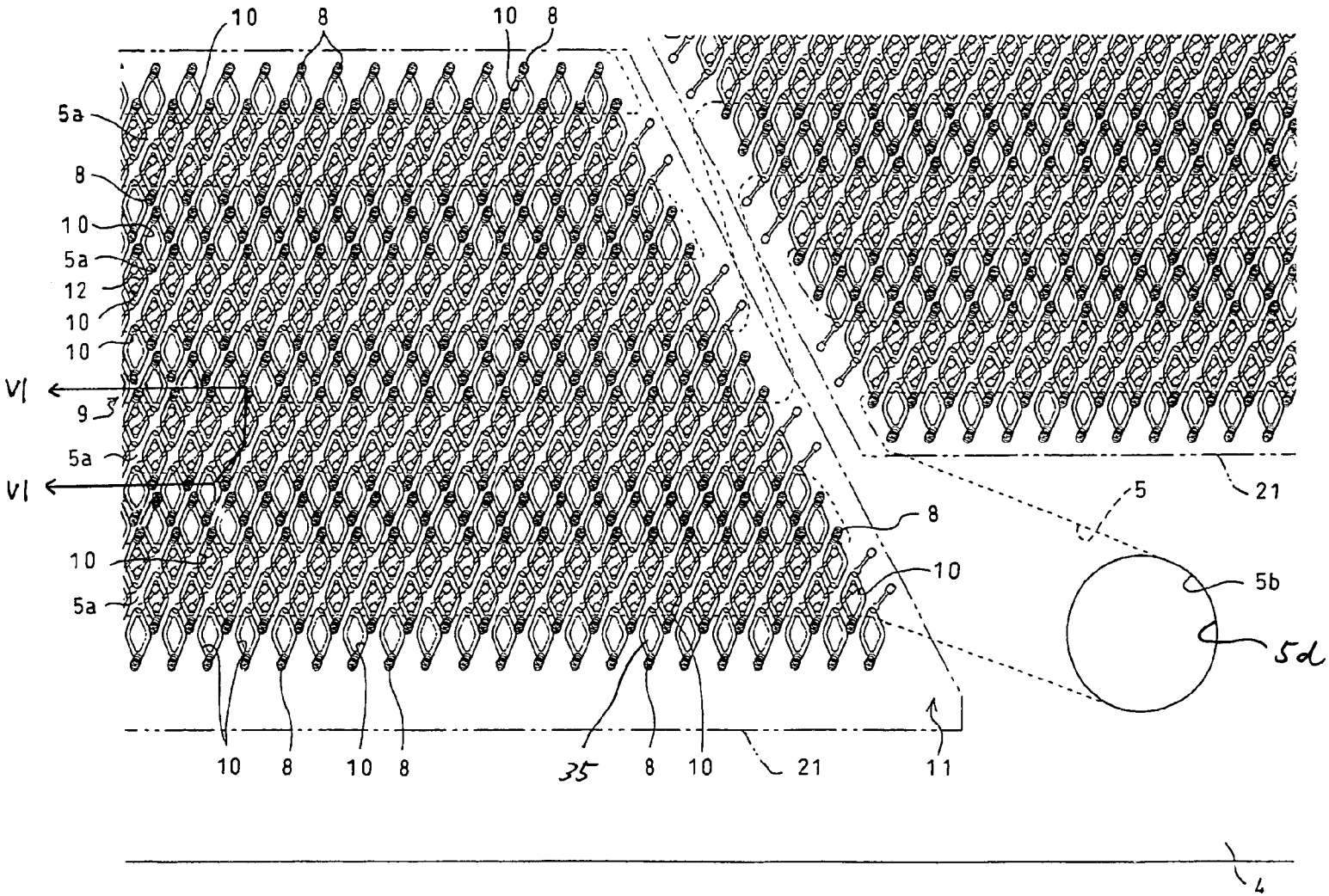
FIG. 5 is an enlarged plan view of a region in FIG. 4 surrounded by a one-dot-and-one-chain line.
Figure 6A:
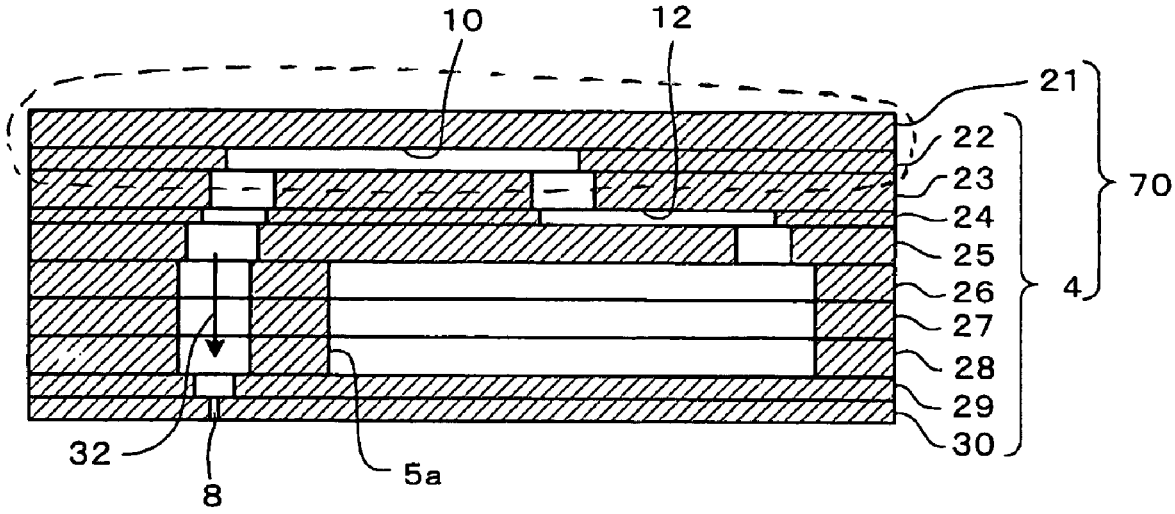
FIG. 6(*a*) is a cross-sectional view taken along a line VI—VI in FIG. 5.
Figure 6B:
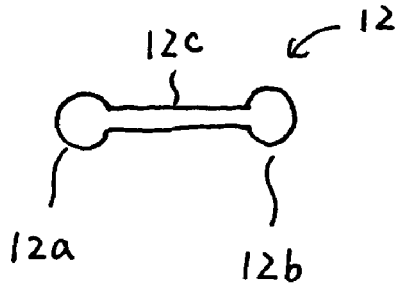
Figure 7:
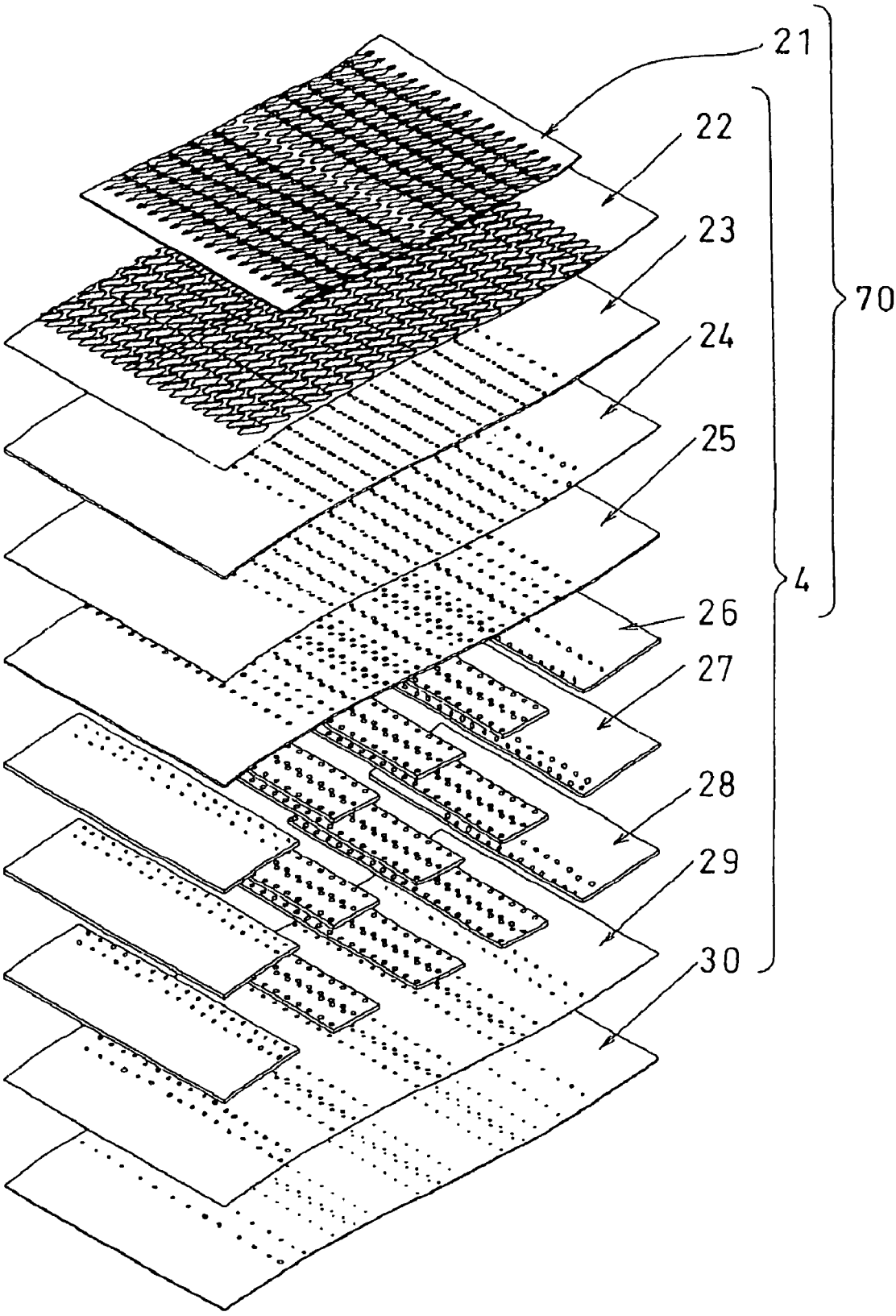
FIG. 7 is an exploded perspective view showing a portion of the main head member depicted in FIG. 5.
Figure 8A:
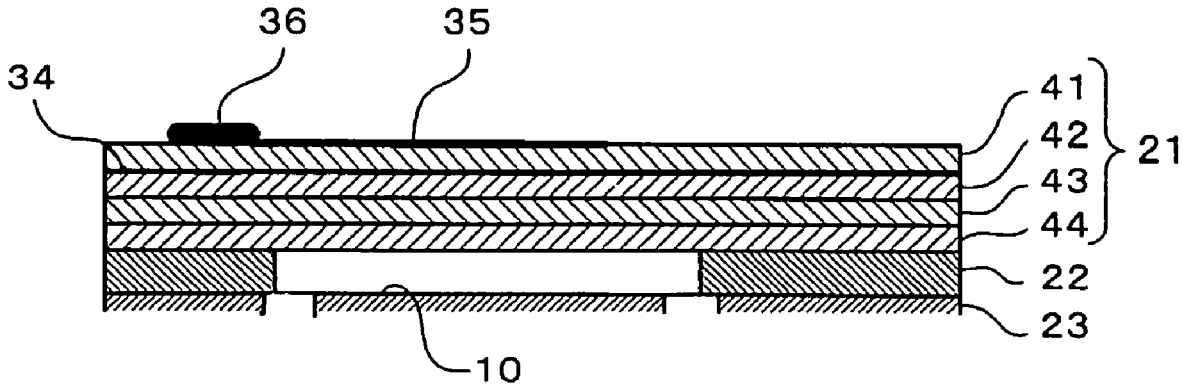
FIG. 8(*a*) is an enlarged cross-sectional view of a portion surrounded by a broken line in FIG. 6(*a*)
Figure 8B:
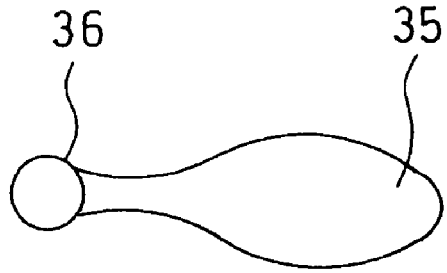

FIG. 4 is a plan view showing the main head member 70 of FIG. 1. FIG. 5 is an enlarged plan view showing the region in FIG. 4 surrounded by a one-dot-and-one-chain line. It is noted that for purposes of description, pressure chambers 10 (pressure chamber groups 9), apertures 12, and nozzles 8 (which will be described later) are depicted with solid lines in FIG. 5, although they are beneath the actuator units 21 and should be depicted in dotted lines. FIG. 6(*a*) is a cross-sectional view taken along a line VI—VI in FIG. 5. FIG. 6(*b*) is a plan view of an aperture 12 shown in FIG. 6(*a*). FIG. 7 is an exploded perspective view showing a part of the main head member 70. FIG. 8(*a*) is an enlarged cross-sectional view of a part surrounded by a broken line in FIG. 6(*a*). FIG. 8(*b*) is a plan view showing the shape of an individual electrode 35 shown in FIG. 8(*a*).

As shown in FIGS. 4 and 5, the main head member 70 includes the channel unit 4. A plurality of (four, in this embodiment) actuator units 21 are bonded to the top surface of the channel unit 4. The actuator units 21 are disposed in a staggered arrangement of two rows on the top surface of the channel unit 4. Each actuator unit 21 has a trapezoidal-shape cross-section along a plane parallel to the top and bottom surfaces of the actuator unit 21. Each trapezoidal-shaped actuator unit 21 is positioned with its parallel sides (top and bottom sides of the trapezoid) aligned with the longitudinal direction (main scanning direction) of the channel unit 4. The trapezoidal-shaped actuator units 21 are arranged on the top surface of the channel unit 4 so that the slanted sides (slanted sides of the trapezoids) of each two neighboring actuator units 21 confront with each other with a gap being formed therebetween.

A plurality of (four, in this embodiment) ink ejection regions 11 (FIG. 5) are defined on the bottom surface of the channel unit 4 in one-to-one correspondence with a plurality of (four, in this embodiment) regions of the top surface of the channel unit 4, on which the plurality of (four, in this embodiment) actuator units 21 are bonded.

As shown in FIG. 5, numerous nozzles 8 are formed on the bottom surface of the channel unit 4 in each ink ejection region 11. The nozzles 8 are arranged in a matrix form in the ink ejection region 11. Numerous pressure chambers 10, each of which is in fluid communication with a single nozzle 8, are formed on the top surface of the channel unit 4 and are arranged also in a matrix. A single pressure chamber group 9 is configured of a plurality of the pressure chambers 10 that are disposed on the top surface of the channel unit 4 in correspondence with the area in which a single actuator unit 21 is bonded. In this way, the numerous pressure chambers 10 are grouped into a plurality of (four, in this embodiment) pressure chamber groups 9. Each pressure chamber 10 has a substantially diamond-shaped cross-section along a plane parallel to the top and bottom surfaces of the chamber unit 4.

As shown in FIG. 4, a manifold 5 is formed inside the channel unit 4. The manifold 5 is configured from a plurality of sub-manifolds 5*a*. A plurality of (ten, in this embodiment) openings 5*b* are formed in the top surface of the channel unit 4 in fluid communication with the manifold 5. More specifically, a lower ink supply channel 5*d* extends from each opening 5*b* to corresponding sub-manifolds 5*a*.

As will be described with reference to FIG. 9(*a*) and FIG. 10, each opening 5*b* is joined with a corresponding upper ink supply channel 3*d*, which is opened on the bottom surface of the reservoir unit 71. Ink in the reservoir unit 71 is therefore supplied through the upper ink supply channels 3*d* to the lower ink supply channels 5*d*, and then to the sub-manifolds 5*a*.

As shown in FIG. 6(*a*), each nozzle 8 grows narrower toward its tip end. Each nozzle 8 is in fluid communication with a sub-manifold 5*a* via a corresponding pressure chamber 10 and a corresponding aperture 12. The sub-manifold 5*a* is a branch channel of the manifold 5.

Next, the cross-sectional structure of the main head member 70 will be described.

As shown in FIG. 6(*a*), each nozzle 8 is in fluid communication with a corresponding sub-manifold 5*a* via a corresponding pressure chamber 10 and a corresponding aperture 12. Accordingly, an individual ink channel 32 is formed in the main head member 70 for each pressure chamber 10 and extends from the outlet of the sub-manifold 5*a* to the nozzle 8 via the aperture 12 and the pressure chamber 10.

As shown in FIG. 7, the main head member 70 has a laminated structure that includes a total of ten stacked sheets. From top to bottom, these sheets include the actuator unit 21, a cavity plate 22, a base plate 23, an aperture plate 24, a supply plate 25, manifold plates 26, 27, and 28, a cover plate 29, and a nozzle plate 30. The channel unit 4 is configured of nine of these metal plates, excluding the actuator unit 21. These nine metal plates are formed of the same metal materials of stainless steel SUS316.

As will be described in detail later with reference to FIG. 8(*a*), the actuator unit 21 includes four laminated piezoelectric sheets 41–44, of which only the topmost sheet 41 has active layer portions (hereinafter referred to as the "active layer") when an electric field is generated by electrodes, while the remaining three sheets 42–43 are inactive layers.

The cavity plate 22 is a metal plate provided with a plurality of substantially diamond-shaped openings (through-holes) defining the pressure chambers 10.

The base plate 23 is a metal plate. For each pressure chamber 10 in the cavity plate 22, the base plate 23 is formed with a communication through-hole connecting the pressure chamber 10 to a corresponding aperture 12 and another communication through-hole connecting the pressure chamber 10 to a corresponding nozzle 8.

The aperture plate 24 is a metal plate. For each pressure chamber 10 in the cavity plate 22, the aperture plate 24 is formed with a communication through-hole connecting the pressure chamber 10 to the nozzle 8. The aperture plate 24 is further formed with the aperture 12 for each pressure chamber 10 in the cavity plate 22. The aperture 12 penetrates through the aperture plate 24. As shown in FIG. 6(*b*), the aperture 12 has an elongated shape and includes: one circular-shaped end 12*a* that is in communication with the pressure chamber 10; the other circular-shaped end 12*b* that is in communication with the sub-manifold 5*a*; and a connecting section 12*c* that connects the circular-shaped ends 12*a* and 12*b* with each other. Each of the circular shaped ends 12*a* and 12*b* and the connecting section 12*c* penetrate through the aperture plate 24. Each of the circular-shaped ends 12*a* and 12*b* has a circular cross-section along a plane parallel to the top and bottom surfaces of the aperture plate 24. The connecting section 12*c* has an elongated cross-section along a plane parallel to the top and bottom surfaces of the aperture plate 24, and has a width smaller than the diameters of the cross-section of the circular-shaped ends 12*a* and 12*b*. The aperture 12 is formed in the aperture plate 24 through an etching.

The supply plate 25 is a metal plate. For each pressure chamber 10 in the cavity plate 22, the supply plate 25 is provided with a communication through-hole connecting the aperture 12 and the sub-manifold 5*a* and a communication through-hole connecting the pressure chamber 10 with the nozzle 8.

The manifold plates 26, 27, and 28 are each provided with a through-hole for configuring the sub-manifold 5*a* when the plates are laminated together. For each pressure chamber 10 in the cavity plate 22, each plate 26, 27, and 28 is further formed with a communication through-hole connecting the pressure chamber 10 to the nozzle 8.

The cover plate 29 is a metal plate. For each pressure chamber 10 in the cavity plate 22, the cover plate 29 is provided with a communication through-hole connecting the pressure chamber 10 to the nozzle 8.

The nozzle plate 30 is a metal plate provided with the nozzle 8 for each pressure chamber 10 in the cavity plate 22.

These nine metal plates 22–30 are aligned and stacked together to form the ink channel 32 as shown in FIG. 6(*a*). The ink channel 32 begins from the sub-manifold 5*a* proceeding upward, extends horizontally in the aperture 12 before again proceeding upward, again extends horizontally in the pressure chamber 10, and then proceeds downward to the nozzle 8, first at a slant away from the aperture 12 and then straight downward.

Next, the structure of the actuator unit 21 will be described. The actuator unit 21 is stacked on the cavity plate 22, which is the topmost layer of the channel unit 4.

As shown in FIG. 8(*a*), the actuator unit 21 includes the four piezoelectric sheets 41–44, each having the same thickness of approximately 15 μm. These piezoelectric sheets 41–44 are continuous laminated plates (continuous planar layers) that span the plurality of pressure chambers 10 formed in a single ink ejection region 11 of the main head member 70 (FIG. 4 and FIG. 5). By disposing the piezoelectric sheets 41–44 as continuous planar layers over the plurality of pressure chambers 10, individual electrodes 35 can be densely arranged on the piezoelectric sheet 41 using a screen printing technique or the like. Therefore, the pressure chambers 10 can also be densely arranged at positions corresponding to the individual electrodes 35, enabling the printing of high-resolution images. The piezoelectric sheets 41–44 are formed of ferroelectric ceramics such as lead zirconate titanate (PZT).

The individual electrodes 35 are formed on top of the piezoelectric sheet 41, the topmost layer. The individual electrodes 35 are bonded to the top surface of the piezoelectric sheet 41. A common electrode 34 formed as a sheet with a uniform thickness of approximately 2 μm is interposed between the piezoelectric sheets 41 and 42. Electrodes are not provided between the piezoelectric sheets 42 and 43 and between the piezoelectric sheets 43 and 44. Both the individual electrodes 35 and the common electrode 34 are formed of a metal material such as Ag—Pd.

Each of the individual electrodes 35 is planar with a thickness of approximately 1 μm and is substantially diamond-shaped, as shown in FIG. 8(*b*), similar to the pressure chambers 10 shown in FIG. 5. A circular land 36 having a diameter of approximately 160 μm protrudes upwardly from one acute angle end of the individual electrode 35. The circular land 36 is electrically connected to the individual electrode 35. The land 36 is formed of gold including glass frit, for example. As shown in FIG. 8(*a*), the land 36 is bonded to the surface of an extended part of the individual electrode 35. The land 36 is electrically joined to a contact provided on the FPC 50.

The common electrode 34 is electrically grounded in an area not shown in the drawing, enabling the common electrode 34 to be maintained equally at a ground potential for all areas corresponding to the pressure chambers 10. Further, the individual electrodes 35 are connected to the driver ICs 80 via the lands 36 and the FPCs 50, which include a plurality of independent lead wires for the plurality of individual electrodes 35 in order to independently control the potential of the individual electrodes 35 corresponding to the plurality of pressure chambers 10.

Next, a method of driving the actuator unit 21 will be described. The polarizing direction of the piezoelectric sheet 41 is equal to the direction of its thickness. Specifically, the actuator unit 21 has a unimorph structure in which the single piezoelectric sheet 41 on the top side (separated from the pressure chamber 10) serves as active layers, while the three piezoelectric sheets 42–44 on the bottom side (near the pressure chamber 10) are inactive layers. Accordingly, when a prescribed positive or negative potential is applied to individual electrodes 35 and if the directions of the electric field and polarization are the same, for example, areas of the piezoelectric sheet 41, which are interposed between the electrodes 35 and the common electrode 34 and at which an electric field is applied, function as active layers and compress in a direction orthogonal to the polarizing direction due to the transverse piezoelectric effect. The piezoelectric sheets 42–44 are not affected by the electric field and therefore do not spontaneously compress. Accordingly, a difference in strain between the piezoelectric sheet 41 and the piezoelectric sheets 42–44 is produced in the direction orthogonal to the polarizing direction, causing all of the piezoelectric sheets 41–44 to deform in a convex shape on the inactive side (unimorph deformation).

As shown in FIG. 8(*a*), since the bottom surface of the actuator unit 21 is fixed to the top surface of the cavity plate 22, which serves to partition the pressure chambers 10, the piezoelectric sheets 41–44 effectively deform in a convex shape toward the pressure chamber 10 side. As a result, the volumes of the pressure chambers 10 decrease, increasing the pressure of the ink and causing ink to eject from the nozzles 8. When the individual electrodes 35 are subsequently returned to the same potential as the common electrode 34, the piezoelectric sheets 41–44 return to their original shape and the pressure chambers 10 return to their original volumes, drawing ink in from the manifold 5 side.

Next, the structure of the reservoir unit 71 will be described in greater detail.

FIG. 9(*a*) and FIG. 9(*b*) are cross-sectional views of the reservoir unit 71 taken along a line IX—IX in FIG. 1. FIG. 9(*a*) is a cross-sectional view of the entire reservoir unit 71, while FIG. 9(*b*) is an enlarged cross-sectional view showing the region in FIG. 9(*a*) surrounded by a broken line having alternate long and double short dashes. FIG. 10 is an exploded view of the reservoir unit 71, with plan views of each plate constituting the reservoir unit 71. In FIG. 9(*a*) and FIG. 9(*b*), the scale of the drawings is exaggerated vertically for purposes of description.

As shown in FIG. 9(*a*), the reservoir unit 71 has a laminated structure including first through seventh plates 91–97. The plates 91–97 are rectangular in shape extending in the main scanning direction and are formed of the same metal materials of the metal plates 22–30 in the channel unit 4 described above.

When aligned and laminated, the plates 91–97 form the ink downflow channel 3*b*, the ink reservoir 3*c*, and the upper ink supply channels 3*d* in the reservoir unit 71. The ink inlet 3*a* is provided as an opening on the upstream side of the ink downflow channel 3*b*, while the downflow opening 63 is provided as another opening on the downstream side of the ink downflow channel 3*b*. The ink inlet 3*a* is positioned at the edge on the top surface of the reservoir unit 71, while the downflow opening 63 confronts the center of the ink reservoir 3*c*.

The ink reservoir 3*c* is in fluid communication with the ink downflow channel 3*b* via the downflow opening 63. The ink reservoir 3*c* is also in fluid communication with the ten upper ink supply channels 3*d*. Five upper ink supply channels 3*d* are arranged along the main scanning direction on each widthwise side of the reservoir unit 71. Since FIG. 9(*a*) is a cross-sectional view, only the five upper ink supply channels 3*d* and the five lower ink supply channels 5*d* formed on one widthwise side of the reservoir unit 71 are shown.

Next, each of the plates in the reservoir unit 71 will be described with reference to FIG. 10.

A total of four rectangular notches 53*a* are formed in both edges of the first plate 91 in the sub-scanning direction (a direction normal to the surface of FIG. 9(*a*)) with the two notches 53*a* in one edge staggered from the two notches 53*a* in the other edge in the main scanning direction. A circular through-hole 45 is formed in one end of the plate 91 with respect to the main scanning direction and near the center in the sub-scanning direction. The opening in the top of the through-hole 45 constitutes the ink inlet 3*a*.

A total of four rectangular notches 53*b* are formed in both edges of the second plate 92 with respect to the sub-scanning direction such that the two notches 53*b* in one edge are staggered from the two notches 53*b* in the other edge in the main scanning direction. As shown in FIG. 9(*a*), an elongated through-hole 46 is formed in the second plate 92 penetrating the same in the thickness direction and extends parallel to the main scanning direction from a position opposing the through-hole 45 to the center of the second plate 92 in the main scanning direction.

The third plate 93 (filter plate) is formed with no notches 53*a* or 53*b*, but has a width in the sub-scanning direction identical to the width of the first and second plates 91 and 92 in the sub-scanning direction between notches 53*a* and 53*b*, respectively. In other words, the third plate 93 has a width smaller than the width of the first plate 91 by an amount equal to twice the amount of the notch 53*a*. In other words, the third plate 93 has a width smaller than the width of the second plate 92 by an amount equal to twice the amount of the notch 53*b*. In this example, the third plate 93 has a width of about 22 mm in the sub-scanning direction, and a length of about 180 mm in the main scanning direction. The third plate 93 has a thickness of about 50 μm in this example.

As shown in FIG. 9(*b*) and FIG. 10, a recess 65 is formed in the third plate 93. A part of the plate 93, on which the recess 65 is formed, will be referred to as "bottom wall portion 65*b*" of the recess 65 hereinafter, and a remaining part of the plate 93, which is other than the bottom wall portion 65 and which surrounds the recess 65 in the main scanning direction and in the sub-scanning direction, will be referred to as "peripheral wall portion 65*c*". The top surface of the peripheral wall portion 65*c* is attached to the second plate 92, while the bottom surface of the peripheral wall portion 65*c* is attached to the fourth plate 94. The bottom surface of the bottom wall portion 65*b* is on the same plane with the bottom surface of the peripheral wall portion 65*c*.

The top surface of the bottom wall portion 65*b* is shifted in the thickness direction of the third plate 93 from the top surface of the peripheral wall portion 65*c* by an amount of the depth of the recess 65. In other words, the thickness of the bottom wall portion 65*b* is less than the thickness of the peripheral wall portion 65*c*, that is, the thickness of the third plate 93. In this example, the depth of the recess 65 is about 47 μm. In other words, the thickness of the bottom wall portion 65*b* is about 3 μm.

The recess 65 extends parallel to the main scanning direction from the center of the plate 93 toward the end corresponding to the through-hole 45. The recess 65 has a width of about 10 mm in the sub-scanning direction, and a length of about 42 mm in the main scanning direction. In other words, the bottom wall portion 65*b* extends parallel to the main scanning direction from the center of the plate 93 toward the end corresponding to the through-hole 45. The bottom wall portion 65*b* has a width of about 10 mm in the sub-scanning direction, and a length of about 42 mm in the main scanning direction.

A partitioning wall 65*a* is disposed in the center of the recess 65 and extends in the sub-scanning direction. The partitioning wall 65*a* protrudes upwardly in the thickness direction of the plate 93 from the bottom wall portion 65*b*. The partitioning wall 65*a* is connected to a pair of opposite sides of the peripheral wall portion 65*c*, which confront with each other in the sub-scanning direction. The partitioning wall 65*a* divides the recess 65 in two compartments. More specifically, the partitioning wall 65*a* partitions the bottom wall portion 65*b* into an upstream region 65*u* and a downstream region 65*d* with respect to a direction A, in which ink flows in the elongated through-hole 46 in the second plate 92 (upper ink downflow channel 64*a*) as will be described later.

The height of the partitioning wall 65*a* in the thickness direction of the plate 93 is substantially the same as the height of the peripheral wall portion 65*c*. In other words, the top surface of the partitioning wall 65*a* is on the same plane with the top surface of the peripheral wall portion 65*c*. Accordingly, the partitioning wall 65*a* can reinforce the bottom wall portion 65*b* and suppress weakening of the plate 93, thereby preventing damage to the filter 67.

The shape of the partitioning wall 65*a* in plan is not limited to that shown in FIG. 10, but may be formed in other various shapes, such as a lattice shape, if the region of the recess 65 can be made appropriately large. Further, by connecting one or both ends of the partitioning wall 65*a* to the peripheral wall portion 65*c*, the reinforcing effect of the partitioning wall 65*a* on the filter 67 is further enhanced.

A plurality of through-holes 66 is formed in rows in the main scanning direction in the bottom wall portion 65*b*. In other words, the through-holes 66 are arranged in the main scanning direction. The bottom wall portion 65*c*, which is located on a bottom of the recess 65 and which is formed with the through-holes 66, constitutes a filter 67. By providing a large recess 65 elongated in the main scanning direction in this way, the size of the filter 67 is large, and numerous through-holes 66 can be formed in the bottom of the recess 65, thereby reducing the channel resistance on ink passing through the filter 67.

It is noted that the through-holes 66 are formed in both of the upstream region 65*u* and the downstream region 65*d*. That is, at least one through-hole 66 is formed in each of the upstream region 65*u* and the downstream region 65*d*. In this embodiment, the total number of the through-holes 66 formed in the upstream region 65*u* is the same as that of the through-holes 66 formed in the downstream region 65*d*.

As shown in FIG. 9(*b*), each through-hole 66 has a circular cross-section along a plane parallel to the top and bottom surfaces of the third plate 93. Each through-hole 66 is formed such that the surface area in the opening on the upstream end of the through-hole 66 with respect to a direction B, in which ink flows through the filter 67, is smaller than that in the opening on the downstream end. In this example, the surface area in the opening on the upstream end of the through-holes 66 has a diameter of about 11 μm, while the surface area in the opening on the downstream end has a diameter of about 13 μm. It is noted that each nozzle 8 has a diameter of about 20 μm. By forming the opening in the downstream end of the through-hole 66 with a large surface area, the filtering effect of the through-hole 66 is the same as when the opening on the downstream end is formed smaller than that on the upstream end, but the flow resistance on ink passing through the through-hole 66 can be decreased. In other words, if the opening on the downstream end, or outlet, of the through-holes 66 is formed smaller than the opening on the upstream end, or inlet, ink can easily flow into the through-holes 66 but cannot easily flow out, thereby raising the flow resistance in the through-holes 66. However, since the opening on the upstream end is made smaller than the opening on the downstream end in the present embodiment, ink flowing into the through-hole 66 through the opening on the upstream end can easily flow out through the opening on the downstream end, thereby reducing flow resistance.

A total of four rectangular notches 53*c* are formed in the side edges of the fourth plate 94 with respect to the sub-scanning direction, wherein two of the notches 53*c* formed in one edge are staggered from the two formed in the other edge in the main scanning direction. As shown in FIG. 9(*a*) and FIG. 9(*b*), a through-hole 68 is formed in the plate 94 at a position opposing the filter 67 and penetrates the plate 94 in the thickness direction. As shown in FIG. 10, the through-hole 68 is elongated in the main scanning direction.

A total of four rectangular notches 53*d* are formed in the side edges of the fifth plate 95 with respect to the sub-scanning direction, wherein two of the notches 53*d* formed in one edge are staggered from the two formed in the other edge in the main scanning direction. A circular through-hole 69 is formed in the center of the fifth plate 95 with respect to both the main scanning direction and the sub-scanning direction. The opening on the downstream end of the through-hole 69 constitutes the downflow opening 63.

A total of four rectangular notches 53*e* are formed in the side edges of the sixth plate 96 with respect to the sub-scanning direction, wherein two of the notches 53*e* formed in one edge are staggered from the two formed in the other edge in the main scanning direction. A through-hole 31 is formed in the center of the plate 96 with respect to both the main scanning direction and the sub-scanning direction. The through-hole 31 constitutes the ink reservoir 3*c*. The ink reservoir 3*c* includes a main channel 37 and eight subsidiary channels 38. The main channel 37 extends in the main scanning direction and tapers from the center of the ink reservoir 3*c* toward two tip ends 3*ce*, which are located near both ends of the plate 96 in the main scanning direction. The eight subsidiary channels 38 branch off the main channel 37 and taper toward eight tip ends 3*ce*, which are located on both sides of the plate 96 in the sub-scanning direction. In this way, the ink reservoir 3*c* has a plurality of (ten, in this embodiment) tip ends 3*ce* at points corresponding to through-holes 33, which are formed in the seventh plate 97 to constitute the plurality of (ten, in this embodiment) upper ink supply channels 3*d* as will be described later.

A total of four rectangular notches 53*f* are formed in the side edges of the seventh plate 97 with respect to the sub-scanning direction, wherein two of the notches 53*f* formed in one edge are staggered from the two formed in the other edge in the main scanning direction.

The ten through-holes 33 are formed in the plate 97. Each through-hole 33 constitutes the upper ink supply channel 3*d*. Each through-hole 33 has a substantially circular cross-section along a plane parallel to the top and bottom surfaces of the seventh plate 87. Five through-holes 33 are formed on each side of the plate 97 with respect to the sub-scanning direction, and are arranged along the main scanning direction. Further, the through-holes 33 formed in opposing sides of the plate 97 with respect to the sub-scanning direction are staggered in the main scanning direction by two units of two through-holes 33 and one unit of one through-hole 33 that is near an end of the plate 97 in the main scanning direction. The through-holes 33 are arranged symmetrically about a center point of the plate 97 with respect to the main scanning direction and the sub-scanning direction.

A recess 39 is formed by half etching in the surface of the plate 97 opposing the channel unit 4. The outline of the recess 39 is indicated by broken lines in FIG. 10. The recess 39 is opened at the both edges of the plate 97 in the sub-scanning direction at the notches 53*f*. The recess 39 forms the space 85 described above when the plate 97 is stacked on the top surface of the channel unit 4, as shown in FIG. 9(*a*).

When aligned, the notches 53*a*–53*f* formed in the first, second, and fourth through seventh plates 91, 92, and 94–97 constitute the four rectangular cutouts 53 for leading out the four FPCs 50, which are connected to the four actuator units 21.

When a thermosetting adhesive is applied between each of the first through seventh plates 91–97 and the plates are bonded together by applying heat and pressure, the reservoir unit 71 configured of the plates 91–97 does not warp in a direction perpendicular to the top surface or bottom surface thereof, because the plates 91–97 are formed of the same metal materials. In other words, because the plates 91–97 are formed of the same metal materials, the linear expansion coefficients of the plates are equal to one another and hence each of the plates expands equally within the plane parallel to the top and bottom surfaces thereof when heat and pressure are applied. Accordingly, the reservoir unit 71 configured by joining the plates 91–97 with heat and pressure does not warp. Even if the third plate 93 shown in FIG. 9(*a*) is formed of a different material than the other plates 91, 92, and 94–97 and therefore planar expansion of the plate 93 is different from those of the other plates, since the plate 93 is interposed between the second and fourth plates 92 and 94, the reservoir unit 71 configured of the plates 91–97 exhibits almost no warp when the plates 91–97 are bonded by heat and pressure. It is noted, however, that when the plate 93 is formed of a different material than the other plates 91, 92, and 94–97, it is desirable to select, for the plate 93, a material whose linear expansion coefficient is similar to the linear expansion coefficients of the other plates 91, 92, and 94–97 as much as possible to deter warping in the reservoir unit 71. In the present embodiment, both the channel unit 4 and the reservoir unit 71 are configured of metal plates to improve the durability of the inkjet head 1.

Next, the ink channels in the reservoir unit 71 will be described.

Ink supplied from an ink tank (not shown) into the ink downflow channel 3*b* via the ink inlet 3*a* flows down into the ink reservoir 3*c* through the downflow opening 63. The filter 67 is disposed in the ink downflow channel 3*b* as described above. The ink inlet 3*a* is formed on one end of the reservoir unit 71 in the main scanning direction. The downflow opening 63 (circular through-hole 69) is formed at a position opposing the center region of the ink reservoir 3*c* that includes the center location among the plurality of upper ink supply channels 3*d*. The filter 67 divides the ink downflow channel 3*b* into an upper ink downflow channel 64*a* formed above the filter 67 as a channel upstream of the filter 67, and a lower ink downflow channel 64*b* formed below the filter 67 as a channel downstream of the filter 67. As shown in FIG. 9(*a*), the upper ink downflow channel 64*a* is defined by a space provided by the through-hole 46, while the lower ink downflow channel 64*b* is defined by a space provided by the through-holes 68 and 69. Hence, ink, which is supplied through the ink inlet 3*a* provided on one end of the reservoir unit 71 in the main scanning direction, is guided through the ink downflow channel 3*b* to flow into the downflow opening 63, which is provided in the center of the reservoir unit 71 in the main scanning direction, thereby flowing into the center area of the ink reservoir 3*c*.

Because the filter 67 is disposed in the ink downflow channel 3*b*, the filter 67 has a large area and attains a small flow resistance on the ink being filtered. Specifically, since the cross-sectional area of the ink channel leading to the manifold 5 is greater than a microchannel such as the ink channel 32 in communication with the nozzle 8, the filter 67 can be configured with a large surface area by being disposed in this ink channel.

The ink reservoir 3*c* serves not only to store ink, but also to supply ink to the upper ink supply channels 3*d*. The ink reservoir 3*c* is in fluid communication with the upper ink supply channels 3*d* at the ten tip ends 3*ce*. These ten tip ends 3*ce* are positioned in correspondence with the ten through-holes 33 constituting the upper ink supply channels 3*d* formed in the plate 97 and are in fluid communication with the through-holes 33. The ten tip ends 3*ce* are arranged in two rows in the reservoir unit 71 along the main scanning direction, with five tip ends 3*ce* located on each side of the reservoir unit 71 in the sub-scanning direction. The tip ends 3*ce* on opposing sides are staggered in units of one formed near an end in the main scanning direction and the remainder in units of two. The ink reservoir 3*c* has a cross-sectional shape, along a plane parallel to the top and bottom surfaces of the plate 96, that is symmetrical about a center point of the plate 96 with respect to the main scanning direction, the center point being the point, at which ink flows from the downflow opening 63 into the ink reservoir 3*c*.

The upper ink supply channels 3*d* are in fluid communication with the ink reservoir 3*c* on their upstream sides and are in fluid communication with the manifold 5 via the lower ink supply channels 5*d* on their downstream sides. The upper ink supply channels 3*d* receive ink from the ink reservoir 3*c* and supply ink to the manifold 5. The upper ink supply channels 3*d* are formed in two rows along the main scanning direction, with five on each side of the reservoir unit 71 in the sub-scanning direction, and are located in one-to-one correspondence with the tip ends 3*ce* of the ink reservoir 3*c*. The upper ink supply channels 3*d* on opposing sides of the reservoir unit 71 are staggered in units of two, except for one upper ink supply channel 3*d* formed near both ends of the reservoir unit 71 in the main scanning direction. Hence, the upper ink supply channels 3*d* are arranged symmetrically about a center point of the plate 97 with respect to the main scanning direction that corresponds to the point at which ink flows into the ink reservoir 3*c* from the downflow opening 63.

Next, the flow of ink in the reservoir unit 71 will be described.

Ink introduced into the ink inlet 3*a* of the reservoir unit 71 from an ink tank not shown in the drawings flows vertically (in the direction in which the plates 91–97 constituting the reservoir unit 71 are stacked) down into the ink downflow channel 3*b*. Ink that reaches the ink downflow channel 3*b* flows along the upper ink downflow channel 64*a* substantially in the main scanning direction and horizontally over the filter 67 (the direction along the planar surfaces of the plates 91–97), while being filtered through the filter 67. After passing through the filter 67, by which foreign matter is removed from the ink, the ink forms a vertical flow following the lower ink downflow channel 64*b* and flows down through the downflow opening 63 into the center region of the ink reservoir 3*c*. From the center region of the ink reservoir 3*c*, the ink flows toward both tip ends of the main channel 37 in the main scanning direction. A portion of ink reaches the tips 3*ce* at the ends of the main channel 37, and flows into the upper ink supply channels 3*d*. A remaining portion of the ink that flows through the main channel 37 flows into the plurality of sub-channels 38 branching off of the main channel 37. Ink reaching the end of these sub-channels 38 flows into the upper ink supply channels 3*d*. Ink introduced into the upper ink supply channels 3*d* flows through the upper ink supply channels 3*d* into the lower ink supply channels 5*d* of the channel unit 4 and is supplied to the manifold 5.

Next, a method of manufacturing the reservoir unit 71 will be described.

All of the plates 91–97 of the reservoir unit 71, excluding the third plate 93, are formed using an etching method well known in the art for producing the through-holes 31, 33, 45, and 69 and the elongated through-holes 46 and 48 in the plates 91, 92, and 94–97 and a punching process for forming the notches 53*a*–53*f* in the plates 91, 92, and 94–97. As described above, the recess 39 is formed in the bottom surface of the seventh plate 97 by half etching.

The filter 67 is formed in the third plate of the reservoir unit 71 according to the steps shown in FIG. 11(*a*)–FIG. 11(*e*).

FIG. 11(*a*) shows the plate material for the plate 93 prior to forming the filter 67. FIG. 11(*b*) shows the plate 93 after resist layers have been formed on the surfaces thereof. FIG. 11(*c*) shows the plate 93 after holes that will become the through-holes 66 have been formed in the bottom surface of the plate 93 and the resist layers have been removed. FIG. 11(*d*) shows the plate 93 after resist layers have again been formed over the surfaces of the plate 93. FIG. 11(*e*) shows the plate 93 after the recess 65 has been formed therein and the resist layers have been removed to complete formation of the filter 67.

In order to form the filter 67 in the plate 93, first, material for the plate 93 is prepared with no alterations, as shown in FIG. 11(*a*).

Then, resist layers 101 (101*a* and 10*b*) are formed on the top and bottom surfaces of the plate 93, as shown in FIG. 11(*b*). At this time, the resist layer 101*a* is formed over the entire top surface of the plate 93, while the resist layer 101*b* is formed over the bottom surface of the plate 93, excluding regions for forming the plurality of through-holes 66. After forming the resist layers 101 in this way, the plate 93 is immersed in a chemical solution that etches away areas of the plate 93 not covered by the resist layers 101 until semicircular depressions 66*a* have been formed, as shown in FIG. 11(*c*).

Subsequently, the resist layers 101 are removed from the plate 93, as shown in FIG. 11(*c*).

Next, other resist layers 102 are formed over the entire bottom surface of the plate 93 and over the top surface, excluding regions for forming the recess 65, as shown in FIG. 11(*d*). Hence, the top surface of the plate 93 is coated with the resist layer 102 so as to expose regions in which the plurality of depressions 66*a* have been formed and to cover all other areas (including the region in which the partitioning wall 65*a* is formed). After forming the resist layers 102, the plate 93 is immersed in a chemical solution that is allowed to etch away depressions in the plate 93 at areas not covered by the resist layers 102 (regions indicated by dotted lines in FIG. 11(*d*)) until the newly-created depressions reach the depressions 66*a*.

Subsequently, the resist layers 102 are removed from the plate 93, as shown in FIG. 11(*e*). In this way, it is possible to form in the plate 93 the plurality of through-holes 66, the recess 65 in fluid communication with the through-holes 66, and the partitioning wall 65*a*, thereby forming the filter 67 in the plate 93.

Hence, when forming the filter 67 in the plate 93, first, depressions 66*a* that will eventually become the through-holes 66 are formed in the bottom surface of the plate 93 by etching the bottom surface.

Next, the recess 65 and the partitioning wall 65*a* are formed by etching the top surface of the plate 93, simultaneously forming the through-holes 66 by connecting the bottom surface of the recess 65 with the depressions 66*a*.

Since the through-holes 66 of the filter 67 are formed from the bottom surface side of the plate 93 through the isotropic etching of a chemical solution, the area of the opening on the bottom surface side of the through-holes 66 in the thickness direction of the plate 93 is greater than the area of the opening on the top surface side. Accordingly, by disposing the plate 93 so that the upper surface side is the upstream side of the ink channel, the flow resistance to ink passing through the through-holes 66 is reduced, as described above.

Further, by forming the plurality of through-holes 66 in the bottom surface of the recess 65, it is possible to form through-holes 66 with small diameters and having a sufficient capacity for removing foreign matter, even when the plate 93 is relatively thick. Since the through-holes 66 can be formed with small diameters, a large number of the through-holes 66 can be formed densely within the region of the filter 67. Therefore, it is possible to use a thick plate 93 to facilitate handling when stacking the plate 93 with the other plates 91, 92, and 94–97, while also producing a filter 67 having numerous through-holes 66 with small diameters and an excellent filtering effect. This method also prevents an increase in flow resistance on ink passing through the filter 67 formed in the plate 93.

Further, the cost of manufacturing the third plate 93 having the filter 67 formed by etching can be much less than manufacturing a filter plate formed of a synthetic resin plate in which a plurality of through-holes have been formed with an excimer laser. Hence, the inkjet head 1 having this filter 67 can be manufactured at a low cost.

With the inkjet head 1 according to the embodiment described above, the filter 67 formed in the plate 93 of the reservoir unit 71 is configured of the recess 65 and the plurality of through-holes 66 formed in the bottom of the recess 65, enabling through-holes 66 with small diameters to be formed in a thick plate. Specifically, by providing the recess 65 in the plate 93, the bottom portion of the recess 65 in which the through-holes 66 are formed can be made extremely thin, reducing the amount of etching in the planar direction of the plate 93 when forming the through-holes 66 by etching. As a result, the through-holes 66 can be formed with small diameters. Since a plurality of the through-holes 66 can be formed in the bottom of the recess 65, the flow resistance on ink passing through the filter 67 is reduced. Further, since a filter 67 having sufficient filtering capacity can be provided in a thick plate, the strength of the plate 93 in which the filter 67 is formed is not degraded, improving the handling of the plate 93 when laminating plates to form the reservoir unit 71.

While it is common to use a thinner plate for forming filter through-holes with a smaller diameter by etching, a thinner plate is not desirable when considering the handling strength of the plate. However, if a thicker plate is employed and etching is used to form through-holes from one surface side of the thick plate, the diameter of the through-holes grows in proportion to the thickness of the plate, because the etching proceeds isotropically.

Contrarily, according to the present embodiment, the filter 67 is formed in a thick plate with consideration for handling, and the through-holes 66 are formed in the bottom portion of the recess 65 formed in the plate. Therefore, a large number of small through-holes can be formed in the bottom of the recess, without being influenced by the thickness of the plate. Hence, the present embodiment can provide a plate that has the filter 67 having a sufficient filtering capacity and sufficient strength for handling, and that does not unduly increase flow resistance on the ink.

Next, an inkjet head according to a second embodiment of the present invention will be described.

FIG. 12(*a*) and FIG. 12(*b*) are cross-sectional views of the reservoir unit in an inkjet head according to the second embodiment, wherein FIG. 12(*a*) is a cross-sectional view showing the entire reservoir unit, while FIG. 12(*b*) is an enlarged cross-sectional view of the region in FIG. 12(*a*) surrounded by a broken line with alternating long and double short dashes. For purposes of description, the vertical dimension of the reservoir unit in FIG. 12(*a*) and FIG. 12(*b*) is exaggerated. Parts and components similar to those of the inkjet head 1 according to the first embodiment described above are indicated by the same reference numerals to avoid duplicating description.

An inkjet head 201 according to the second embodiment includes a reservoir unit 271 shown in FIG. 12(*a*). The reservoir unit 271 has the same construction as the reservoir unit 71 according to the first embodiment described above, except that a third plate 93' is used instead of the third plate 93 of the first embodiment and that the third plate 93' has a filter 267 instead of the filter 67 in the first embodiment.

The filter 267 includes: the bottom wall portion 65*b* defining the recess 65 thereon; a plurality of through-holes 266 and a plurality of through-holes 268, both of which are formed in the bottom wall portion 65*b*; and the partitioning wall 65*a*. As shown in FIG. 12(*b*), the partitioning wall 65*a* partitions the bottom wall portion 65*b* into the upstream region 65*u* and the downstream region 65*d* with respect to the direction A, in which ink flows in the upper ink downflow channel 64*a*. The through-holes 266 are formed in the upstream region 65*u*, while the through-holes 268 are formed in the downstream region 65*d*. The total number of the through-holes 266 is the same as that of the through-holes 268. Each of the through-holes 266 and 268 is shaped similar to the through-hole 66 in the first embodiment. More specifically, the area of the opening of each through-hole 266 in the bottom surface side of the third plate 93' is greater than the area of the opening of the through-hole 266 on the top surface side, and the area of the opening of each through-hole 267 in the bottom surface side of the third plate 93' is greater than the area of the opening of the through-hole 267 on the top surface side. According to the present embodiment, however, each through-hole 266 is formed with a smaller diameter than each through-hole 268. For example, the diameter of each through-holes 266 is smaller than that of the through-hole 268 by an amount of about 2 μm.

The method of forming the filter 267 in the third plate 93' according to the present embodiment is substantially the same as the method of forming the filter 67 in the plate 93 according to the first embodiment. However, when forming the areas of the through-holes 266 and 268 by etching, the resist layer is formed on the third plate 93' at regions corresponding to the through-holes 266 and 268 having different diameters. Hence, the resist layer is formed at different regions than the resist layer 101*b* in the first embodiment described above. Otherwise, the method of forming the filter 267 in the third plate 93' is identical to the method of forming the filter 67 in the first embodiment.

In addition to the advantages obtained by the ink-jet head 1 according to the first embodiment described above, the inkjet head 201 according to the second embodiment obtains the following advantages.

By forming the diameter of the through-holes 268 in the filter 267 larger than that of the through-holes 266, the through-holes 268 have less pressure loss than the through-holes 266. For this reason, ink flowing through the through-holes 268 has less flow resistance, facilitating the flow of ink in the downstream region of the upper ink downflow channel 64*a* and preventing bubbles from accumulating in the ink in the area of the upper ink downflow channel 64*a* that confronts the through-holes 268. More specifically, since the ink downflow channel 3*b* changes the ink flow from a horizontal direction A in the upper ink downflow channel 64*a* to a vertical direction B in the lower ink downflow channel 64*b*, the flow of ink tends to stagnate in a corner P shown in FIG. 12(*a*) in the downstream region of the upper ink downflow channel 64*a*, and air bubbles in the ink tend to accumulate at this corner P. However, in the present embodiment, ink flows more freely through the through-holes 268 provided near the corner P in the downstream region of the upper ink downflow channel 64*a*, thereby preventing air bubbles from accumulating in the corner P.

In the inkjet head 1 of the first embodiment described above, the number of the through-holes 66 formed in the upstream region 65*u* is equal to the number of the through-holes 66 formed in the downstream region 65*d*, and all of the through-holes 66 have the same diameter. However, the number of through-holes 66 in the upstream region 65*u* may be made smaller than the number in the downstream region 65*d* in order to produce a differential in pressure loss between the upstream side and downstream side of the upper ink downflow channel 64*a*, thereby reducing the pressure loss of ink passing through the through-holes 66 formed in the downstream region 65*d*. Hence, the flow resistance on ink passing through the through-holes 66 formed in the downstream region 65*d* can be made less than the flow resistance on ink passing through through-holes 66 formed in the upstream region 65*u*, thereby facilitating the flow of ink through the downstream region of the upper ink downflow channel 64*a* so that air bubbles in the ink have less tendency to accumulate in the corner P of the downstream region.

While the invention has been described in detail with reference to the specific embodiments thereof, it would be apparent to those skilled in the art that various changes and modifications may be made therein without departing from the spirit of the invention.

For example, the filter may be formed in the individual ink channels in the channel unit 4. For example, the filter may be formed at a location between the lower ink supply channel 5*d* and the sub-manifold 5*a*.

The partitioning wall 65*a* may be eliminated from the filter 67 and the filter 267.

The openings in the top surface side of the through-holes 66 formed in the filter 67 may be larger than the openings in the downstream end. That is, when forming the filter 67, the recess 65 may be formed first, and the through-holes 66 may be subsequently formed in the thin bottom portion of the recess 65 from the recess 65 side.

Further, in the preferred embodiments, the partitioning wall 65*a* is formed in the ink downflow channel 3*b* to extend in the sub-scanning direction (orthogonal to the direction A of ink flow), but may be formed to extend in the main scanning direction (the direction A of ink flow). This construction can produce a smooth flow of ink through the upper ink downflow channel 64*a*. In this case, it is desirable that the downstream end of the partitioning wall 65*a* be connected to the peripheral wall portion 65*c*. This construction serves not only as a structural reinforcement of the filter 67 or filter 267, but also to guide air bubbles in the ink to the downstream side of the upper ink downflow channel 64*a*. Especially in a filter constructed like the filter 267 of the second embodiment to facilitate ink flow in the downstream region of the filter 267, air bubbles in the ink can be easily discharged rather than being accumulated.

Further, the method for forming the filter 67 in the plate 93 is not limited to an etching method. The present invention may be applied to any method for forming filter through-holes by removing plate material isotropically from one surface side of the plate.

What is claimed is:

1. An inkjet head, comprising:

a plurality of laminated plates, the plates having holes that are arranged in communication with one another to form an ink channel, at least one of the plurality of plates including a filter portion disposed in the ink channel, the filter portion including a bottom wall portion defining a depression thereon, a plurality of filter through-holes being formed through the bottom wall portion, wherein an area of an opening in each filter through-hole on an upstream side of the ink channel in an ink flowing direction through the filter portion is smaller than an area of another opening in the subject filter through-hole on a downstream side of the ink channel.

2. The inkjet head according to claim 1, wherein the at least one plate includes a first surface and a second surface opposite to the first surface, the bottom wall portion including a first bottom surface and a second bottom surface opposite to the first bottom surface, the depression being located on the first bottom surface, a bottom thickness defined as a distance between the first bottom surface and the second bottom surface being smaller than a plate thickness defined as a distance between the first surface and the second surface.

3. The inkjet head according to claim 1, wherein the at least one plate includes a peripheral wall portion, the depression being surrounded by the bottom wall portion and the peripheral wall portion, the peripheral wall portion having a first surface and a second surface opposite to the first surface, the bottom wall portion including a first bottom surface and a second bottom surface opposite to the first bottom surface, the depression being located on the first bottom surface, a bottom thickness defined as a distance between the first bottom surface and the second bottom surface being smaller than a plate thickness defined as a distance between the first surface and the second surface.

4. The inkjet head according to claim 3, wherein the second surface is located on the same plane with the second bottom surface, and wherein the first bottom surface is shifted from the first surface by a depth of the depression, the depth of the depression being equal to a difference between the plate thickness and the bottom thickness.

5. The inkjet head according to claim 1, wherein the plurality of plates include an ink-inlet plate formed with an ink inlet, further comprising:

a nozzle plate formed with a plurality of nozzles; and another plurality of laminated plates formed with a common ink chamber that is in fluid communication with the ink channel and that is in fluid communication with the plurality of nozzles, the ink channel being configured so that ink supplied from an external source through the ink inlet flows through the common ink chamber toward the plurality of nozzles to be ejected.

6. The inkjet head according to claim 5, wherein the filter portion is disposed in the ink channel between the ink inlet and the common ink chamber.

7. The inkjet head according to claim 6, wherein the ink channel includes an ink reservoir that stores ink therein, the ink reservoir being disposed between the ink inlet and the common ink chamber; and the filter portion is disposed in a reservoir channel defined between the ink inlet and the ink reservoir.

8. The inkjet head according to claim 7, wherein the plurality of filter through-holes in the filter portion include:

an upstream-side filter through-hole; and a downstream-side filter through-hole that is located in a downstream side of the upstream-side filter through-hole in the ink flowing direction along the reservoir channel, the upstream-side filter through-hole having a smaller diameter than the downstream-side filter through-hole.

9. The inkjet head according to claim 1, wherein the at least one plate is elongated in a predetermined direction, the depression being elongated in the predetermined direction, and the plurality of filter through-holes are arranged along the predetermined direction.

10. The inkjet head according to claim 1, wherein the filter portion has a partitioning wall that divides the depression into a plurality of compartments, each compartment including at least one filter through-hole.

11. The inkjet head according to claim 10, wherein both ends of the partitioning wall connect to peripheral wall portions of the depression, and the thickness of the plate is greater than the thickness of the bottom wall portion of the depression.

12. The inkjet head according to claim 1, wherein each of the plurality of plates is a metal plate.

13. The inkjet head according to claim 1, further comprising a channel unit in which a plurality of nozzles and a plurality of pressure chambers are formed, wherein the plurality of laminated plates configure a reservoir unit fixed to the channel unit, the reservoir unit including in the ink channel:

an ink inlet;

an ink reservoir;

a reservoir channel connecting the ink reservoir to the ink inlet, the filter portion being disposed in the reservoir channel; and a plurality of first ink supply channels communicating outside of the reservoir unit with the ink reservoir, the channel unit including:

a common ink chamber;

a plurality of individual ink channels extending from an outlet of the common ink chamber through the plurality of pressure chambers to the plurality of nozzles; and a plurality of second ink supply channels in fluid communication with the corresponding first ink supply channels to connect the ink reservoir to the common ink chamber.

14. The inkjet head according to claim 13, wherein the channel unit is configured of another plurality of laminated plates having holes for forming the nozzles, the pressure chambers, the common ink chamber, the individual ink channels, and the plurality of second ink supply channels, and wherein each plate in the channel unit is a metal plate and each plate in the reservoir unit is a metal plate.

15. The inkjet head according to claim 14, wherein the plurality of filter through-holes are formed by etching one surface side of the metal plate, and the depression is formed by etching the opposite surface of the metal plate.

16. The inkjet head according to claim 15, wherein the metal plate having the filter portion is formed of the same metal material as the other metal plates constituting the channel unit and the reservoir unit.

17. A filter plate for an inkjet head, the inkjet head including a plurality of laminated plates, the plurality of plates including the filter plate, the plurality of laminated plates having holes that are arranged to form an ink channel, the filter plate comprising:

a filter portion, which is disposed in the ink channel which is formed when the plurality of plates are laminated together, the filter portion including a bottom wall portion defining a depression thereon, a plurality of filter through-holes being formed through the bottom wall portion, wherein an area of an opening in each filter through-hole on an upstream side of the ink channel in an ink flowing direction through the filter portion is smaller than an area of another opening in the subject filter through-hole on a downstream side of the ink channel.

18. The filter plate according to claim 17, further comprising a peripheral wall portion, the depression being surrounded by the bottom wall portion and the peripheral wall portion, the peripheral wall portion having a first surface and a second surface opposite to the first surface, the bottom wall portion including a first bottom surface and a second bottom surface opposite to the first bottom surface, the depression being located on the first bottom surface, a bottom thickness defined as a distance between the first bottom surface and the second bottom surface being smaller than a plate thickness defined as a distance between the first surface and the second surface, the second surface being located on the same plane with the second bottom surface, and the first bottom surface being shifted from the first surface by a depth of the depression, the depth of the depression being equal to a difference between the plate thickness and the bottom thickness.

19. A method of manufacturing a filter plate serving as a component of an inkjet head including a plurality of laminated plates, the plates having holes that are arranged to form an ink channel, the filter plate having a filter portion that traps foreign matter in ink in the ink channel, the method comprising:

forming a plurality of holes within a predetermined region on one surface of a metal plate, the holes having a depth smaller than the thickness of the metal plate; and forming filter through-holes penetrating the metal plate by etching a depression across the entire predetermined region on the opposite surface of the metal plate, the depression connecting the holes, thereby forming through-holes.

20. The method of manufacturing a filter plate according to claim 19, wherein the hole forming step includes:

forming a resist layer on the one surface of the metal plate, while exposing hole forming regions desired to form the plurality of holes, and forming another resist layer over the entire surface of at least the predetermined region on the opposite surface of the metal plate;

forming the plurality of holes by etching the hole forming regions; and removing the resist layers from the metal plate.

21. The method of manufacturing a filter plate according to claim 19, wherein the depression forming step includes:

forming a resist layer over the entire surface of at least the predetermined region on the one surface of the metal plate and forming a resist layer on the opposite surface while exposing the predetermined region;

forming the depression by etching the predetermined region; and removing the resist layers from the metal plate.

22. A filter plate for an inkjet head, the inkjet head including a plurality of laminated plates including the filter plate, the plurality of laminated plates having holes that are arranged to form an ink channel, the filter plate being formed with a depression that is to be located in the ink channel when the plurality of plates are laminated together, a plurality of filter through-holes being formed through a bottom portion of the depression, wherein an area of an opening in each filter through-hole on an upstream side of the ink channel in an ink flowing direction through the filter portion is smaller than an area of another opening in the subject filter through-hole on a downstream side of the ink channel.

23. An inkjet head, comprising:

a plurality of laminated plates, the plates having holes that are arranged in communication with one another to form an ink channel, at least one of the plurality of plates being formed with a depression at a location in the ink channel, a plurality of filter through-holes being formed through a bottom of the depression, wherein an area of an opening in each filter through-hole on an upstream side of the ink channel in an ink flowing direction through the filter portion is smaller than an area of another opening in the subject filter through-hole on a downstream side of the ink channel.

* * * * *